US009257219B2

(12) United States Patent
Fullerton et al.

(10) Patent No.: US 9,257,219 B2
(45) Date of Patent: Feb. 9, 2016

(54) SYSTEM AND METHOD FOR MAGNETIZATION

(71) Applicants: Larry W. Fullerton, New Hope, AL (US); Mark D. Roberts, Huntsville, AL (US); Robert Scott Evans, Austin, TX (US)

(72) Inventors: Larry W. Fullerton, New Hope, AL (US); Mark D. Roberts, Huntsville, AL (US); Robert Scott Evans, Austin, TX (US)

(73) Assignee: CORRELATED MAGNETICS RESEARCH, LLC., New Hope, AL (US)

( * ) Notice: Subject to any disclaimer, the term of this patent is extended or adjusted under 35 U.S.C. 154(b) by 100 days.

(21) Appl. No.: 13/959,201

(22) Filed: Aug. 5, 2013

(65) Prior Publication Data

US 2014/0035707 A1 Feb. 6, 2014

Related U.S. Application Data

(60) Provisional application No. 61/742,260, filed on Aug. 6, 2012.

(51) Int. Cl.

| | |
|---|---|
| ***H01F 13/00*** | (2006.01) |
| ***B41J 2/43*** | (2006.01) |
| ***H01F 7/20*** | (2006.01) |
| *H01F 27/28* | (2006.01) |

(52) U.S. Cl.

CPC . *H01F 13/00* (2013.01); *B41J 2/43* (2013.01); *H01F 7/20* (2013.01); *H01F 27/2847* (2013.01)

(58) Field of Classification Search

CPC ..... H01F 13/00; H01F 7/20; H01F 27/2847

USPC ..... 336/223, 232; 335/284–295, 299

See application file for complete search history.

(56) References Cited

U.S. PATENT DOCUMENTS

| | | | |
|---|---|---|---|
| 93,931 | A | 8/1869 | Westcott |
| 342,666 | A | 5/1886 | Williams |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog Number: CFP1290B-PRT, ISBN: 978-1-4673-0143-5.

(Continued)

*Primary Examiner* — Mohamad Musleh
(74) *Attorney, Agent, or Firm* — William J. Tucker

(57) ABSTRACT

A system and a method are described herein for magnetizing magnetic sources into a magnetizable material. In one embodiment, the method comprises: (a) providing an inductor coil having multiple layers and a hole extending through the multiple layers; (b) positioning the inductor coil next to the magnetizable material; and (c) emitting from the inductor coil a magnetic field that magnetizes an area on a surface of the magnetizable material, wherein the area on the surface of the magnetizable material that is magnetized is in a direction other than perpendicular to the magnetizable material such that there is a magnetic dipole with both a north polarity and a south polarity formed on the surface of the magnetizable material.

20 Claims, 17 Drawing Sheets

(56) References Cited

U.S. PATENT DOCUMENTS

| | | | |
|---|---|---|---|
| 361,248 | A | 4/1887 | Winton |
| 400,809 | A | 4/1889 | Van Depoele |
| 405,109 | A | 5/1889 | Williams |
| 450,543 | A | 4/1891 | Van Depoele |
| 493,858 | A | 3/1893 | Edison |
| 675,323 | A | 5/1901 | Clark |
| 687,292 | A | 11/1901 | Armstrong |
| 996,933 | A | 7/1911 | Lindquist |
| 1,024,418 | A | 4/1912 | Podlesak |
| 1,081,462 | A | 12/1913 | Patton |
| 1,171,351 | A | 2/1916 | Neuland |
| 1,180,489 | A | 4/1916 | Geist |
| 1,184,056 | A | 5/1916 | Deventer |
| 1,236,234 | A | 8/1917 | Troje |
| 1,252,289 | A | 1/1918 | Murray, Jr. |
| 1,290,190 | A | 1/1919 | Herrick |
| 1,301,135 | A | 4/1919 | Karasick |
| 1,307,342 | A | 6/1919 | Brown |
| 1,312,546 | A | 8/1919 | Karasick |
| 1,323,546 | A | 8/1919 | Karasick |
| 1,554,236 | A | 1/1920 | Simmons |
| 1,343,751 | A | 6/1920 | Simmons |
| 1,544,010 | A | 6/1925 | Jordan |
| 1,554,254 | A | 9/1925 | Zbinden |
| 1,624,741 | A | 12/1926 | Leppke et al. |
| 1,784,256 | A | 12/1930 | Stout |
| 1,785,643 | A | 12/1930 | Noack et al. |
| 1,823,326 | A | 9/1931 | Legg |
| 1,895,129 | A | 1/1933 | Jones |
| 1,975,175 | A | 10/1934 | Scofield |
| 2,048,161 | A | 7/1936 | Klaiber |
| 2,058,339 | A | 10/1936 | Metzger |
| 2,147,482 | A | 12/1936 | Butler |
| 2,111,643 | A | 3/1938 | Salvatori |
| 2,130,213 | A | 9/1938 | Wolf et al. |
| 2,158,132 | A | 5/1939 | Legg |
| 2,186,074 | A | 1/1940 | Koller |
| 2,240,035 | A | 4/1941 | Catherall |
| 2,243,555 | A | 5/1941 | Faus |
| 2,245,268 | A | 6/1941 | Goss et al. |
| 2,269,149 | A | 1/1942 | Edgar |
| 2,286,897 | A | 6/1942 | Costa et al. |
| 2,296,754 | A | 9/1942 | Wolf et al. |
| 2,315,045 | A | 3/1943 | Breitenstein |
| 2,316,616 | A | 4/1943 | Powell |
| 2,327,748 | A | 8/1943 | Smith |
| 2,337,248 | A | 12/1943 | Koller |
| 2,337,249 | A | 12/1943 | Koller |
| 2,362,151 | A | 11/1944 | Ostenberg |
| 2,389,298 | A | 11/1945 | Ellis |
| 2,401,887 | A | 6/1946 | Sheppard |
| 2,409,857 | A | 10/1946 | Hines et al. |
| 2,414,653 | A | 1/1947 | Lokholder |
| 2,426,322 | A | 8/1947 | Pridham |
| 2,438,231 | A | 3/1948 | Shultz |
| 2,471,634 | A | 5/1949 | Vennice |
| 2,472,127 | A | 6/1949 | Slason |
| 2,475,200 | A | 7/1949 | Roys |
| 2,475,456 | A | 7/1949 | Norlander |
| 2,483,895 | A | 10/1949 | Fisher |
| 2,508,305 | A | 5/1950 | Teetor |
| 2,513,226 | A | 6/1950 | Wylie |
| 2,514,927 | A | 7/1950 | Bernhard |
| 2,520,828 | A | 8/1950 | Bertschi |
| 2,540,796 | A | 2/1951 | Stanton |
| 2,544,077 | A | 3/1951 | Gardner |
| 2,565,624 | A | 8/1951 | Phelon |
| 2,570,625 | A | 10/1951 | Zimmerman et al. |
| 2,640,955 | A | 6/1953 | Fisher |
| 2,690,349 | A | 9/1954 | Teetor |
| 2,694,164 | A | 11/1954 | Geppelt |
| 2,694,613 | A | 11/1954 | Williams |
| 2,701,158 | A | 2/1955 | Schmitt |
| 2,722,617 | A | 11/1955 | Cluwen et al. |
| 2,740,946 | A | 4/1956 | Geneslay |
| 2,770,759 | A | 11/1956 | Ahlgren |
| 2,787,719 | A | 4/1957 | Thomas |
| 2,820,411 | A | 1/1958 | Park |
| 2,825,863 | A | 3/1958 | Krupen |
| 2,837,366 | A | 6/1958 | Loeb |
| 2,842,688 | A | 7/1958 | Martin |
| 2,853,331 | A | 9/1958 | Teetor |
| 2,888,291 | A | 5/1959 | Scott et al. |
| 2,896,991 | A | 7/1959 | Martin, Jr. |
| 2,900,592 | A | 8/1959 | Baruch |
| 2,935,352 | A | 5/1960 | Heppner |
| 2,935,353 | A | 5/1960 | Loeb |
| 2,936,437 | A | 5/1960 | Fraser et al. |
| 2,959,747 | A | 11/1960 | Challacombe et al. |
| 2,962,318 | A | 11/1960 | Teetor |
| 3,024,374 | A | 3/1962 | Stauder |
| 3,055,999 | A | 9/1962 | Lucas |
| 3,089,986 | A | 5/1963 | Gauthier |
| 3,100,292 | A | 8/1963 | Warner, Jr. et al. |
| 3,102,205 | A | 8/1963 | Combs |
| 3,102,314 | A | 9/1963 | Alderfer |
| 3,105,153 | A | 9/1963 | James, Jr. |
| 3,149,255 | A | 9/1964 | Trench |
| 3,151,902 | A | 10/1964 | Ahlgren |
| 3,204,995 | A | 9/1965 | Teetor |
| 3,208,296 | A | 9/1965 | Baermann |
| 3,238,399 | A | 3/1966 | Johanees et al. |
| 3,273,104 | A | 9/1966 | Krol |
| 3,288,511 | A | 11/1966 | Tavano |
| 3,301,091 | A | 1/1967 | Reese |
| 3,351,368 | A | 11/1967 | Sweet |
| 3,382,386 | A | 5/1968 | Schlaeppi |
| 3,408,104 | A | 10/1968 | Raynes |
| 3,414,309 | A | 12/1968 | Tresemer |
| 3,425,729 | A | 2/1969 | Bisbing |
| 2,932,545 | A | 4/1969 | Foley |
| 3,468,576 | A | 9/1969 | Beyer et al. |
| 3,474,366 | A | 10/1969 | Barney |
| 3,496,871 | A | 2/1970 | Stengel |
| 3,500,090 | A | 3/1970 | Baermann |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,690,393 | A | 9/1972 | Guy |
| 3,696,251 | A | 10/1972 | Last et al. |
| 3,696,258 | A | 10/1972 | Anderson et al. |
| 3,707,924 | A | 1/1973 | Barthalon et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,836,801 | A | 9/1974 | Yamashita et al. |
| 3,845,430 | A | 10/1974 | Petkewicz et al. |
| 3,893,059 | A | 7/1975 | Nowak |
| 3,976,316 | A | 8/1976 | Laby |
| 4,079,558 | A | 3/1978 | Forham |
| 4,114,305 | A | 9/1978 | Wohlert et al. |
| 4,115,040 | A | 9/1978 | Knorr |
| 4,117,431 | A | 9/1978 | Eicher |
| 4,129,187 | A | 12/1978 | Wengryn et al. |
| 4,129,846 | A | 12/1978 | Yablochnikov |
| 4,140,932 | A | 2/1979 | Wohlert |
| 4,209,905 | A | 7/1980 | Gillings |
| 4,222,489 | A | 9/1980 | Hutter |
| 4,232,535 | A | 11/1980 | Caldwell |
| 4,296,394 | A | 10/1981 | Ragheb |
| 4,340,833 | A | 7/1982 | Sudo et al. |
| 4,352,960 | A | 10/1982 | Dormer et al. |
| 4,363,980 | A | 12/1982 | Petersen |
| 4,367,450 | A * | 1/1983 | Carillo ..... 336/200 |
| 4,399,595 | A | 8/1983 | Yoon et al. |
| 4,416,127 | A | 11/1983 | Gomez-Olea Naveda |
| 4,421,118 | A | 12/1983 | Dow et al. |
| 4,451,811 | A | 5/1984 | Hoffman |
| 4,453,294 | A | 6/1984 | Morita |
| 4,454,426 | A | 6/1984 | Benson |
| 4,460,855 | A | 7/1984 | Kelly |

(56) References Cited

U.S. PATENT DOCUMENTS 4,500,827 A 2/1985 Merritt et al.
4,517,483 A 5/1985 Hucker et al.
4,535,278 A 8/1985 Asakawa
4,547,756 A 10/1985 Miller et al.
4,629,131 A 12/1986 Podell
4,641,119 A * 2/1987 Moore ..... 335/297
4,645,283 A 2/1987 MacDonald et al.
4,649,925 A 3/1987 Dow et al.
4,680,494 A 7/1987 Grosjean
381,968 A 5/1988 Tesla
4,767,378 A 8/1988 Obermann
4,785,816 A 11/1988 Dow et al.
4,808,955 A 2/1989 Godkin et al.
4,814,654 A 3/1989 Gerfast
4,837,539 A 6/1989 Baker
4,849,749 A 7/1989 Fukamachi et al.
4,856,631 A 8/1989 Okamoto et al.
4,912,727 A 3/1990 Schubert
4,924,123 A 5/1990 Hamajima et al.
4,941,236 A 7/1990 Sherman et al.
4,956,625 A 9/1990 Cardone et al.
4,980,593 A 12/1990 Edmundson
4,993,950 A 2/1991 Mensor, Jr.
4,996,457 A 2/1991 Hawsey et al.
5,013,949 A 5/1991 Mabe, Jr.
5,020,625 A 6/1991 Yamauchi et al.
5,050,276 A 9/1991 Pemberton
5,062,855 A 11/1991 Rincoe
5,123,843 A 6/1992 Van der Zel et al.
5,139,383 A 8/1992 Polyak et al.
5,179,307 A 1/1993 Porter
5,190,325 A 3/1993 Doss-Desouza
5,302,929 A 4/1994 Kovacs
5,309,680 A 5/1994 Kiel
5,345,207 A 9/1994 Gebele
5,347,186 A 9/1994 Konotchick
5,349,258 A 9/1994 Leupold et al.
5,367,891 A 11/1994 Furuyama
5,383,049 A 1/1995 Carr
5,394,132 A 2/1995 Poil
5,396,140 A 3/1995 Goldie et al.
5,425,763 A 6/1995 Stemmann
5,434,549 A 7/1995 Hirabayashi et al.
5,440,997 A 8/1995 Crowley
5,452,663 A 9/1995 Berdut
5,461,386 A 10/1995 Knebelkamp
5,485,435 A 1/1996 Matsuda et al.
5,492,572 A 2/1996 Schroeder et al.
5,495,221 A 2/1996 Post
5,512,732 A 4/1996 Yagnik et al.
5,570,084 A 10/1996 Ritter et al.
5,582,522 A 12/1996 Johnson
5,604,960 A 2/1997 Good
5,631,093 A 5/1997 Perry et al.
5,631,618 A 5/1997 Trumper et al.
5,633,555 A 5/1997 Ackermann et al.
5,635,889 A 6/1997 Stelter
5,637,972 A 6/1997 Randall et al.
5,650,681 A 7/1997 DeLemo
5,730,155 A 3/1998 Allen
5,759,054 A 6/1998 Spadafore
5,788,493 A 8/1998 Tanaka et al.
5,789,878 A 8/1998 Kroeker et al.
5,818,132 A 10/1998 Konotchick
5,852,393 A 12/1998 Reznik et al.
5,902,185 A 5/1999 Kubiak et al.
5,921,357 A 7/1999 Starkovich et al.
5,935,155 A 8/1999 Humayun et al.
5,956,778 A 9/1999 Godoy
5,975,714 A 11/1999 Vetorino et al.
5,983,406 A 11/1999 Meyerrose
5,988,336 A 11/1999 Wendt et al.
6,000,484 A 12/1999 Zoretich et al.
6,039,759 A 3/2000 Carpentier et al.
6,040,642 A 3/2000 Ishiyama
6,047,456 A 4/2000 Yao et al.
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A 9/2000 Cousins
6,124,779 A * 9/2000 Yamamoto ..... 336/200
6,125,955 A 10/2000 Zoretich et al.
6,137,202 A * 10/2000 Holmes et al. ..... 310/180
6,142,779 A 11/2000 Siegel et al.
6,157,100 A 12/2000 Mielke
6,170,131 B1 1/2001 Shin
6,181,110 B1 1/2001 Lampis
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 5/2001 Tsai et al.
6,273,918 B1 8/2001 Yuhasz et al.
6,275,778 B1 8/2001 Shimada et al.
6,285,097 B1 9/2001 Hazelton et al.
6,313,551 B1 11/2001 Hazelton
6,313,552 B1 11/2001 Boast
6,387,096 B1 5/2002 Hyde, Jr.
6,422,533 B1 7/2002 Harms
6,457,179 B1 10/2002 Prendergast
6,467,326 B1 10/2002 Garrigus
6,478,681 B1 11/2002 Overaker et al.
6,517,560 B1 2/2003 Toth et al.
6,540,515 B1 4/2003 Tanaka
6,561,815 B1 5/2003 Schmidt
6,599,321 B2 7/2003 Hyde, Jr.
6,607,304 B1 8/2003 Lake et al.
6,608,540 B1 8/2003 Hones et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,768,230 B2 7/2004 Cheung et al.
6,821,126 B2 11/2004 Neidlein
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,913,471 B2 7/2005 Smith
6,927,657 B1 8/2005 Wu
6,936,937 B2 8/2005 Tu et al.
6,950,279 B2 9/2005 Sasaki et al.
6,952,060 B2 10/2005 Goldner et al.
6,954,938 B2 10/2005 Emberty et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,065,860 B2 6/2006 Aoki et al.
7,066,739 B2 6/2006 McLeish
7,066,778 B2 6/2006 Kretzschmar
7,097,461 B2 8/2006 Neidlein
7,101,374 B2 9/2006 Hyde, Jr.
7,134,452 B2 11/2006 Hiroshi et al.
7,135,792 B2 11/2006 Devaney et al.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,309,934 B2 12/2007 Tu et al.
7,311,526 B2 12/2007 Rohrbach et al.
7,339,790 B2 3/2008 Baker et al.
7,344,380 B2 3/2008 Neidlein et al.
7,351,066 B2 4/2008 DiFonzo et al.
7,358,724 B2 4/2008 Taylor et al.
7,362,018 B1 4/2008 Kulogo et al.
7,364,433 B2 4/2008 Neidlein

(56) References Cited

U.S. PATENT DOCUMENTS 7,381,181 B2 6/2008 Lau et al.
7,402,175 B2 7/2008 Azar
7,416,414 B2 8/2008 Bozzone et al.
7,438,726 B2 10/2008 Erb
7,444,683 B2 11/2008 Prendergast et al.
7,453,341 B1 11/2008 Hildenbrand
7,467,948 B2 12/2008 Lindberg et al.
7,498,914 B2 3/2009 Miyashita et al.
7,583,500 B2 9/2009 Ligtenberg et al.
7,628,173 B2 12/2009 Rosko et al.
7,637,746 B2 12/2009 Lindberg et al.
7,645,143 B2 1/2010 Rohrbach et al.
7,658,613 B1 2/2010 Griffin et al.
7,688,036 B2 3/2010 Yarger et al.
7,762,817 B2 7/2010 Ligtenberg et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 10/2010 Fullerton et al.
7,817,004 B2 10/2010 Fullerton et al.
7,828,556 B2 11/2010 Rodrigues
7,832,897 B2 11/2010 Ku
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,871,272 B2 1/2011 Firman, II et al.
7,874,856 B1 1/2011 Schriefer et al.
7,901,216 B2 3/2011 Rohrbach et al.
7,903,397 B2 3/2011 McCoy
7,905,626 B2 3/2011 Shantha et al.
7,980,268 B2 7/2011 Rosko et al.
7,997,906 B2 8/2011 Ligenberg et al.
8,002,585 B2 8/2011 Zhou
8,004,792 B2 * 8/2011 Biskeborn et al. ..... 360/123.56
8,009,001 B1 8/2011 Cleveland
8,050,714 B2 11/2011 Fadell et al.
8,078,224 B2 12/2011 Fadell et al.
8,078,776 B2 12/2011 Novotney et al.
8,087,939 B2 1/2012 Rohrbach et al.
8,138,868 B2 3/2012 Arnold
8,138,869 B1 3/2012 Lauder et al.
8,143,982 B1 3/2012 Lauder et al.
8,143,983 B1 3/2012 Lauder et al.
8,165,634 B2 4/2012 Fadell et al.
8,177,560 B2 5/2012 Rohrbach et al.
8,187,006 B2 5/2012 Rudisill et al.
8,190,205 B2 5/2012 Fadell et al.
8,242,868 B2 8/2012 Lauder et al.
8,253,518 B2 8/2012 Lauder et al.
8,264,310 B2 9/2012 Lauder et al.
8,264,314 B2 9/2012 Sankar
8,271,038 B2 9/2012 Fadell et al.
8,271,705 B2 9/2012 Novotney et al.
8,297,367 B2 10/2012 Chen et al.
8,344,836 B2 1/2013 Lauder et al.
8,348,678 B2 1/2013 Hardisty et al.
8,354,767 B2 1/2013 Pennander et al.
8,390,411 B2 3/2013 Lauder et al.
8,390,412 B2 3/2013 Lauder et al.
8,390,413 B2 3/2013 Lauder et al.
8,395,465 B2 3/2013 Lauder et al.
8,398,409 B2 3/2013 Schmidt
8,435,042 B2 5/2013 Rohrbach et al.
8,454,372 B2 6/2013 Lee
8,467,829 B2 6/2013 Fadell et al.
8,497,753 B2 7/2013 DiFonzo et al.
8,514,042 B2 8/2013 Lauder et al.
8,535,088 B2 9/2013 Gao et al.
8,576,031 B2 11/2013 Lauder et al.
8,576,034 B2 11/2013 Bilbrey et al.
8,586,410 B2 11/2013 Arnold et al.
8,616,362 B1 12/2013 Browne et al.
8,648,679 B2 2/2014 Lauder et al.
8,665,044 B2 3/2014 Lauder et al.
8,665,045 B2 3/2014 Lauder et al.
8,690,582 B2 4/2014 Rohrbach et al.
8,702,316 B2 4/2014 DiFonzo et al.
8,734,024 B2 5/2014 Isenhour et al.
8,752,200 B2 6/2014 Varshavsky et al.
8,757,893 B1 6/2014 Isenhour et al.
8,770,857 B2 7/2014 DiFonzo et al.
8,774,577 B2 7/2014 Benjamin et al.
8,781,273 B2 7/2014 Benjamin et al.
2002/0125977 A1 9/2002 VanZoest
2003/0170976 A1 9/2003 Molla et al.
2003/0179880 A1 9/2003 Pan et al.
2003/0187510 A1 10/2003 Hyde
2004/0003487 A1 1/2004 Reiter
2004/0155748 A1 8/2004 Steingroever
2004/0244636 A1 12/2004 Meadow et al.
2004/0251759 A1 12/2004 Hirzel
2005/0102802 A1 5/2005 Sitbon et al.
2005/0196484 A1 9/2005 Khoshnevis
2005/0231046 A1 10/2005 Aoshima
2005/0240263 A1 10/2005 Fogarty et al.
2005/0263549 A1 12/2005 Scheiner
2006/0066428 A1 3/2006 McCarthy et al.
2006/0111191 A1 5/2006 Wise
2006/0189259 A1 8/2006 Park et al.
2006/0198047 A1 9/2006 Xue et al.
2006/0214756 A1 9/2006 Elliott et al.
2006/0290451 A1 12/2006 Prendergast et al.
2006/0293762 A1 12/2006 Schulman et al.
2007/0072476 A1 3/2007 Milan
2007/0075594 A1 4/2007 Sadler
2007/0103266 A1 5/2007 Wang et al.
2007/0138806 A1 6/2007 Ligtenberg et al.
2007/0171014 A1 * 7/2007 Iwasa et al. ..... 335/216
2007/0255400 A1 11/2007 Parravicini et al.
2007/0267929 A1 11/2007 Pulnikov et al.
2008/0139261 A1 6/2008 Cho et al.
2008/0181804 A1 7/2008 Tanigawa et al.
2008/0186683 A1 8/2008 Ligtenberg et al.
2008/0218299 A1 9/2008 Arnold
2008/0224806 A1 9/2008 Ogden et al.
2008/0272868 A1 11/2008 Prendergast et al.
2008/0282517 A1 11/2008 Claro
2009/0021333 A1 1/2009 Fiedler
2009/0058201 A1 3/2009 Brennvall
2009/0091195 A1 4/2009 Hyde et al.
2009/0146508 A1 6/2009 Peng et al.
2009/0209173 A1 8/2009 Arledge et al.
2009/0230786 A1 9/2009 Liu
2009/0250576 A1 10/2009 Fullerton et al.
2009/0251256 A1 10/2009 Fullerton et al.
2009/0254196 A1 10/2009 Cox et al.
2009/0278642 A1 11/2009 Fullerton et al.
2009/0289090 A1 11/2009 Fullerton et al.
2009/0289749 A1 11/2009 Fullerton et al.
2009/0292371 A1 11/2009 Fullerton et al.
2010/0033280 A1 2/2010 Bird et al.
2010/0084928 A1 4/2010 Yoshida et al.
2010/0126857 A1 5/2010 Polwart et al.
2010/0167576 A1 7/2010 Zhou
2011/0026203 A1 2/2011 Ligtenberg et al.
2011/0210636 A1 9/2011 Kuhlmann-Wilsdorf
2011/0221552 A1 * 9/2011 Rochford et al. ..... 335/216
2011/0234344 A1 9/2011 Fullerton et al.
2011/0248806 A1 10/2011 Michael
2011/0279206 A1 11/2011 Fullerton et al.
2012/0007704 A1 1/2012 Nerl
2012/0085753 A1 4/2012 Fitch et al.
2012/0235519 A1 9/2012 Dyer et al.
2012/0262261 A1 10/2012 Sarai
2013/0001745 A1 1/2013 Lehmann et al.
2013/0186209 A1 7/2013 Herbst
2013/0186473 A1 7/2013 Mankame et al.
2013/0186807 A1 7/2013 Browne et al.
2013/0187538 A1 7/2013 Herbst
2013/0192860 A1 8/2013 Puzio et al.
2013/0207758 A1 8/2013 Browne et al.
2013/0252375 A1 9/2013 Yi et al.

(56) References Cited

U.S. PATENT DOCUMENTS

| | | | | |
|---|---|---|---|---|
| 2013/0256274 | A1 | 10/2013 | Faulkner | |
| 2013/0270056 | A1 | 10/2013 | Mankame et al. | |
| 2013/0305705 | A1 | 11/2013 | Ac et al. | |
| 2013/0341137 | A1 | 12/2013 | Mandame et al. | |
| 2014/0044972 | A1 | 2/2014 | Menassa et al. | |
| 2014/0072261 | A1 | 3/2014 | Isenhour et al. | |
| 2014/0152252 | A1 | 6/2014 | Wood et al. | |
| 2014/0184378 | A1* | 7/2014 | Wild | 336/207 |
| 2014/0205235 | A1 | 7/2014 | Benjamin et al. | |
| 2014/0221741 | A1 | 8/2014 | Wang et al. | |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | | 1/1938 |
| GB | 1 495 677 | A | 12/1977 |
| JP | 60-091011 | U | 5/1985 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

V. Rudnev, An Objective Assessment of Magnetic Flux Concentrators, Heat Treating Progress, Nov./Dec. 2004, p. 19-23.

Series BNS, Compatible Series AES Safety Controllers, http://www.schmersalusa.com/safety_controllers/drawings/aes.pdf, pp. 159-175, date unknown.

BNS 33 Range, Magnetic safety sensors, Rectangular design, http://www.farnell.com/datasheets/36449.pdf, 3 pages, date unknown.

Series BNS-B20, Coded-Magnet Sensor Safety Door Handle, http://www.schmersalusa.com/catalog_pdfs/BNS_B20.pdf, 2 pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Wikipedia, "Barker Code", Web article, last modified Aug. 2, 2008, 2 pages.

Wikipedia, "Kasami Code", Web article, last modified Jun. 11, 2008, 1 page.

Wikipedia, "Linear feedback shift register", Web article, last modified Nov. 11, 2008, 6 pages.

Wikipedia, "Golomb Ruler", Web article, last modified Nov. 4, 2008, 3 pages.

Wikipedia, "Costas Array", Web article, last modified Oct. 7, 2008, 4 pages.

Wikipedia, "Walsh Code", Web article, last modified Sep. 17, 2008, 2 pages.

Wikipedia, "Gold Code", Web article, last modified Jul. 27, 2008, 1 page.

Wikipedia, "Bitter Electromagnet", Web article, last modified Aug. 2011,1 page.

Pill-soo Kim, "A future cost trends of magnetizer systems in Korea", Industrial Electronics, Control, and Instrumentation, 1996, vol. 2, Aug. 5, 1996, pp. 991-996.

United States Office Action, dated Aug. 26, 2011, issued in counterpart U.S. Appl. No. 12/206,270.

United States Office Action, dated Mar. 12, 2012, issued in counterpart U.S. Appl. No. 12/206,270.

United States Office Action, dated Feb. 22, 2011, issued in counterpart U.S. Appl. No. 12/476,952.

United States Office Action, dated Oct. 12, 2011, issued in counterpart U.S. Appl. No. 12/476,952.

United States Office Action, dated Mar. 9, 2012, issued in counterpart U.S. Appl. No. 13/371,280.

International Search Report and Written Opinion, dated May 14, 2009, issued in related International Application No. PCT/US2009/038925.

International Search Report and Written Opinion, dated Jul. 13, 2010, issued in related International Application No. PCT/US2010/021612.

International Search Report and Written Opinion dated Jun. 1, 2009, issued in related International Application No. PCT/US2009/002027.

International Search Report and Written Opinion, dated Aug. 18, 2010, issued in related International Application No. PCT/US2010/036443.

International Search Report and Written Opinion, dated Apr. 8, 2011 issued in related International Application No. PCT/US2010/049410.

Atallah, K., Calverley, S.D., D. Howe, 2004, "Design, analysis and realisation of a high-performance magnetic gear", IEE Proc.-Electr. Power Appl., vol. 151, No. 2, Mar. 2004.

Atallah, K., Howe, D. 2001, "A Novel High-Performance Magnetic Gear", IEEE Transactions on Magnetics, vol. 37, No. 4, Jul. 2001, p. 2844-2846.

Bassani, R., 2007, "Dynamic Stability of Passive Magnetic Bearings", Nonlinear Dynamics, V. 50, p. 161-168.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-1117.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-1606.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-2.

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

Jian et al., "Comparison of Coaxial Magnetic Gears With Different Topologies", IEEE Transactions on Magnetics, vol. 45, No. 10, Oct. 2009, p. 4526-29.

Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.

Jørgensen et al., "The Cycloid Permanent Magnetic Gear", IEEE Transactions on Industry Applications, vol. 44, No. 6, Nov./Dec. 2008, p. 1659-65.

Jørgensen et al., 2005, "Two dimensional model of a permanent magnet spur gear", Conf. Record of the 2005 IEEE Industry Applications Conference, p. 261-65.

(56) References Cited

OTHER PUBLICATIONS

Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-47.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Notice of Allowance issued in U.S. Appl. No. 13/471,189 dated Apr. 3, 2013.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/855,519 dated Jul. 17, 2013.
Kim, Pill Soo, Kim, Yong, Field and Thermal Modeling of Magnetizing Fixture by Impulse, Power Electronics and Drive Systems, 2003. The fifth conference on, Dec. 2003,1301-1306.
United States Office Action issued in U.S. Appl. No. 13/470,994 dated Aug. 8, 2013.
United States Office Action issued in U.S. Appl. No. 13/430,219 dated Aug. 13, 2013.

* cited by examiner

SYSTEM AND METHOD FOR MAGNETIZATION

CLAIM OF PRIORITY

This application claims the benefit U.S. Provisional Application Ser. No. 61/742,260 filed on Aug. 6, 2012. The contents of this document are incorporated by reference herein.

TECHNICAL FIELD

The present invention relates generally to a system and method for magnetization. More particularly, the present invention relates to a system and method for magnetizing magnetic sources into a magnetizable material.

BACKGROUND

A wide metal inductor coil for magnetizing magnetic sources known as maxels into a magnetizable material is described in U.S. Pat. No. 8,179,219, issued May 15, 2012, the contents of which are incorporated by reference herein. This known wide metal inductive coil 114 is shown in FIGS. 1A-1B (PRIOR ART). The wide metal inductive coil 114 includes a first circular conductor 116*a* having a desired thickness and a hole 118*a* through it and a slotted opening 120*a* extending from the hole 118*a* and across the first circular conductor 116*a* to produce a discontinuity in the first circular conductor 116*a*. The wide metal inductive coil 114 further includes a second circular conductor 116*b* having a hole 118*b* and a slotted opening 120*b* extending from the hole 118*b* and across the circular conductor 116*b* to produce a discontinuity in the second circular conductor 116*b*. The first and second circular conductors 116*a* and 116*b* are designed such that they can be soldered together at a solder joint 122 that is beneath the first circular conductor 116*a* and on top of the second circular conductor 116*b*. Other attachment techniques other than soldering can also be used. Prior to the first and second circular conductors 116*a* and 116*b* being soldered together, insulation layers 124*a* and 124*b* are respectively placed beneath each of the circular conductors 116*a* and 116*b*. The insulation layer 124*a* is placed beneath the first circular conductor 116*a* so it does not cover the solder region 122 but otherwise insulates the remaining portion of the bottom of the first circular conductor 116*a* from the second circular conductor 116*b*. When the first and second circular conductors 116*a* and 116*b* are soldered together the insulation layer 124*a* between them prevents current from conducting between them except at the solder joint 122. The second insulation layer 116*b* beneath the second circular conductor 116*b* prevents current from conducting to the magnetizable material 130 (see FIG. 1B (PRIOR ART)). So, if the magnetizable material 130 is non-metallic, for example, a ceramic material, then the second insulation layer 116*b* is not needed. Moreover, if the magnetizable material 130 has generally insignificant conductive properties then the second insulation layer 116*b* is optional.

A first wire conductor 126 is soldered to the top of the first circular conductor 116*a* at a location next to the slotted opening 120*a* but opposite the solder joint 122. The second circular conductor 116*b* has a grove (or notch) 127 in the bottom of it which can receive a second wire conductor 128 that is then soldered to the second circular conductor 116*b* such that the bottom of the second circular conductor 116*b* remains substantially flat. Other methods can also be employed to connect the second wire conductor 128 to the second circular conductor 116*b* including placing the second wire conductor 128 into a hole drilled through a side of the second circular conductor 116*b* and then soldering the second wire conductor 116 to the second circular conductor 116*b*. As depicted in FIG. 1A (PRIOR ART), the second wire conductor 128 is fed through the holes 118*a* and 118*b* in the first and second circular conductors 116*a* and 116*b* and then through the groove (or notch) 127. Thus, when the two wire conductors 126 and 128 and the first and second circular conductors 116*a* and 116*b* are soldered together with the insulation layer 124*a* in between the two circular conductors 116*a* and 116*b* they form two turns of a coil. In this set-up, the current from the first conductor 126 can enter the first circular conductor 116*a*, travel clockwise around the first circular conductor 116*a*, travel through the solder joint 122 to the second circular conductor 116*b*, travel clockwise around the second circular conductor 116*b* and then out the second wire conductor 128, or current can travel the opposite path. Hence, depending on the connectivity of the first and second wire conductors 126 and 128 to the wide metal inductor coil 114 (magnetizing circuit 114) and the direction of the current received from the wide metal inductor coil 114 (magnetizer circuit), a South polarity magnetic field source or a North polarity magnetic field source are produced in the magnetizing material 130 (see FIG. 1B).

FIG. 1B (PRIOR ART) depicts a side view of a cross section of the wide metal inductor coil 114. A characterization of the magnetic field 119 (dashed lines) produced by the wide metal inductor coil 114 during magnetization illustrates that the wide metal inductor coil 114 produces a strong magnetic field 119 in the holes 118*a* and 118*b*, where the magnetizing field 119 is provided perpendicular (see dashed arrow) to the magnetizable material 130 being magnetized such that a North up or South up polarity magnetic source is printed into the magnetizing material 130. In other words, the magnetic dipole (magnetic source, maxel) has either a North or South polarity on the surface of the magnetizing material 130 and an opposite pole beneath the surface of the magnetizing material 130. Various improved wide metal inductor coils are described in U.S. Non-provisional patent application Ser. No. 12/895,589, filed Sep. 30, 2010, titled "System and Method for Energy Generation", and U.S. patent Non-provisional application Ser. No. 13/240,355, filed Sep. 22, 2011, titled "Magnetic Structure Production", the contents of which are incorporated herein by reference.

Referring to FIGS. 2A-2E (PRIOR ART), there are illustrated different aspects of an exemplary magnetic print head 141 (similar to wide metal inductor coil 114) for a maxel-printing magnetic printer. It should be understood that more or fewer parts than those described and/or illustrated may alternatively comprise the magnetic print head 141. Similarly, parts may be modified and/or combined in alternative manners that differ from those that are described and/or illustrated. For certain example embodiments, FIG. 2B (PRIOR ART) depicts an example outer layer 132 of the magnetic print head 141. The outer layer 132 may comprise a thin metal (e.g., 0.01" thick copper) having a generally round or circular shape (e.g., with a 16 mm diameter) and having substantially one-fourth of the circular shape removed or otherwise not present. The outer layer 132 may include a tab 134 for receiving an electrical connection. The outer layer 132 may define or include at least part of a hole portion 135*a* that, when combined with one or more other layers 136 which has at least part of a hole portion 135*b*, results in a hole 121 (e.g., with a 1 mm diameter) being formed in an approximate center of the magnetic print head 141. As shown for an example implementation, the outer layer 132 may be formed at least partially from a substantially flat plate. An arrow is illustrated on the outer layer 132 to indicate that a current received from the tab 134 may traverse around a three-quarter moon portion of the outer layer 132. It should be noted that sizes, material types, shapes, etc. of component parts are provided by way of example but not limitation; other sizes, material types, shapes, etc. may alternatively be utilized and/or implemented.

For example implementations, a diameter of one or more of the layers 132 and 136 of the magnetic print head 141, which can also have a shape other than round (e.g., oval, rectangular, elliptical, triangular, hexagonal, etc.), may be selected to be large enough to handle a load of a current passing through the print head layers 132 and 136 and also large enough to substantially ensure no appreciable reverse magnetic field is produced near the hole 121 where the magnetic print head 141 produces a maxel (magnetic source) in the magnetizing material 130. Although the hole 121 is also shown to comprise a substantially circular or round shape, this is by way of example only, and it should be appreciated that the hole 121 may alternatively comprise other shapes including but not limited to, oval, rectangular, elliptical, triangular, hexagonal, and so forth. Moreover, a size of the hole 121 may correspond to a desired maxel resolution in the magnetizing material 130, whereby a given print head 141 may have a different sized hole 121 so as to print different sized maxels in the magnetizing material 130. Example diameter sizes of holes 121 in print heads 141 may include, but are not limited to, 0.7 mm to 4 mm. In addition, the diameter sizes of holes 121 may alternatively be smaller or larger, depending on design and/or particular application.

FIG. 2C (PRIOR ART) depicts an example inner layer 136 of the magnetic print head 141. The inner layer 136 may be similar to the outer layer 132, except that it does not include a tab (e.g., see outer layer's tab 134 in FIG. 2B (PRIOR ART)). As shown for an example implementation, current (see arrow) may traverse around the three-quarter moon portion of the inner layer 136.

FIG. 2D (PRIOR ART) depicts an example non-conductive spacer 138 for the magnetic print head 141. The spacer 138 may be designed (e.g., in terms of size, shape, thickness, a combination thereof, etc.) to fill a portion of the outer layer 132 and/or the inner layer 136 such that the layers 132 and 136 have a conductive and a non-conductive portion. In an example implementation, the outer and inner layers 132 and 136 may still provide complete circular structures such that if they are stacked, they have no air regions other than the central hole 121. The central hole 121 may also be filled with a magnetizable material. Although shown as occupying one-quarter of a circle, the spacer 138 may alternatively by shaped differently. If the spacer 138 is included in the design of the print head 141, then the assembled print head 141 would be more rigid and therefore more robust and/or stable to thereby increase its lifecycle.

FIG. 2E (PRIOR ART) depicts an example weld joint 140 between the outer layer 132 and the inner layer 136 with two spacers 138*a* and 138*b*. As shown for an example implementation, the outer and inner layers 132 and 136 may have portions 139*a* and 139*b* that overlap to form the weld joint 140. The weld joint 140 may comprise an area that is used for attaching two layers 132 and 136 via some attachment mechanism including, but not limited to, welding (e.g., heliarc welding), soldering, adhesive, any combination thereof, and so forth.

For an example assembly procedure, prior to attaching the two layers 132 and 136 that are electrically conductive, an insulating material (e.g., Kapton) may be placed on top of the outer layer 132 (and/or beneath the inner layer 136) so as to insulate one layer from the other. After welding, the insulating material may be cut away or otherwise removed from the weld joint 140, which enables the two conductor portions to be electrically attached thereby producing one and one-half turns of an inductor coil. Alternatively, an insulating material may be placed against a given layer 132 or 136 such that it insulates the given layer 132 or 136 from an adjoining layer except for a portion corresponding to the weld joint 140 between the two adjoining layers 132 and 136. During an example operation, an insulating material may prevent current from passing between the layers 132 and 136 except at the weld joint 140 thereby resulting in each adjoining layer acting as three-quarters of a turn of an inductor coil (e.g., of the print head 141) if using example layer designs as illustrated in FIGS. 2B-2C (PRIOR ART).

Although the aforementioned wide metal inductive coil 114 and the magnetic print head 141 work well it is still desirable to improve upon these components or at least how these components can be used in a different manner to form magnetizing magnetic sources (maxels) into a magnetizable material. Such improvements are the subject of the present invention.

SUMMARY

A system and method for magnetizing magnetic sources into a magnetizable material are described in the independent claims of the present application. Advantageous embodiments of the system and method have been described in the dependent claims of the present application.

In one aspect, the present invention provides a system for magnetizing magnetic sources into a magnetizable material. In one embodiment, the system comprises: (a) an inductor coil which has multiple layers forming a coil and a hole extending through the multiple layers; (b) a positioning device configured to position the inductor coil next to the magnetizable material; and (c) an electrical power source configured to provide electricity to the inductor coil such that the inductor coil emits a magnetic field that magnetizes an area on a surface of the magnetizable material, wherein the area on the surface of the magnetizable material is magnetized in a direction other than perpendicular to the magnetizable material such that there is a magnetic dipole with both a north polarity and a south polarity formed on the surface of the magnetizable material. In addition, the system may comprise multiple inductor coils which can magnetize multiple magnetic dipoles each with a north polarity and a south polarity on the surface of the magnetizable material.

In another aspect, the present invention provides a method for magnetizing magnetic sources into a magnetizable material. The method comprises steps of: (a) providing an inductor coil having multiple layers forming a coil and a hole extending through the multiple layers; (b) positioning the inductor coil next to the magnetizable material; and (c) emitting from the inductor coil a magnetic field that magnetizes an area on a surface of the magnetizable material, wherein the area on the surface of the magnetizable material is magnetized in a direction other than perpendicular to the magnetizable material such that there is a magnetic dipole with both a north polarity and a south polarity formed on the surface of the magnetizable material. In addition, the method may utilize multiple inductor coils to magnetize multiple magnetic dipoles each with a north polarity and a south polarity on the surface of the magnetizable material.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be obtained by reference to the following detailed description when taken in conjunction with the accompanying drawings wherein.

DETAILED DESCRIPTION

Figure 1A:
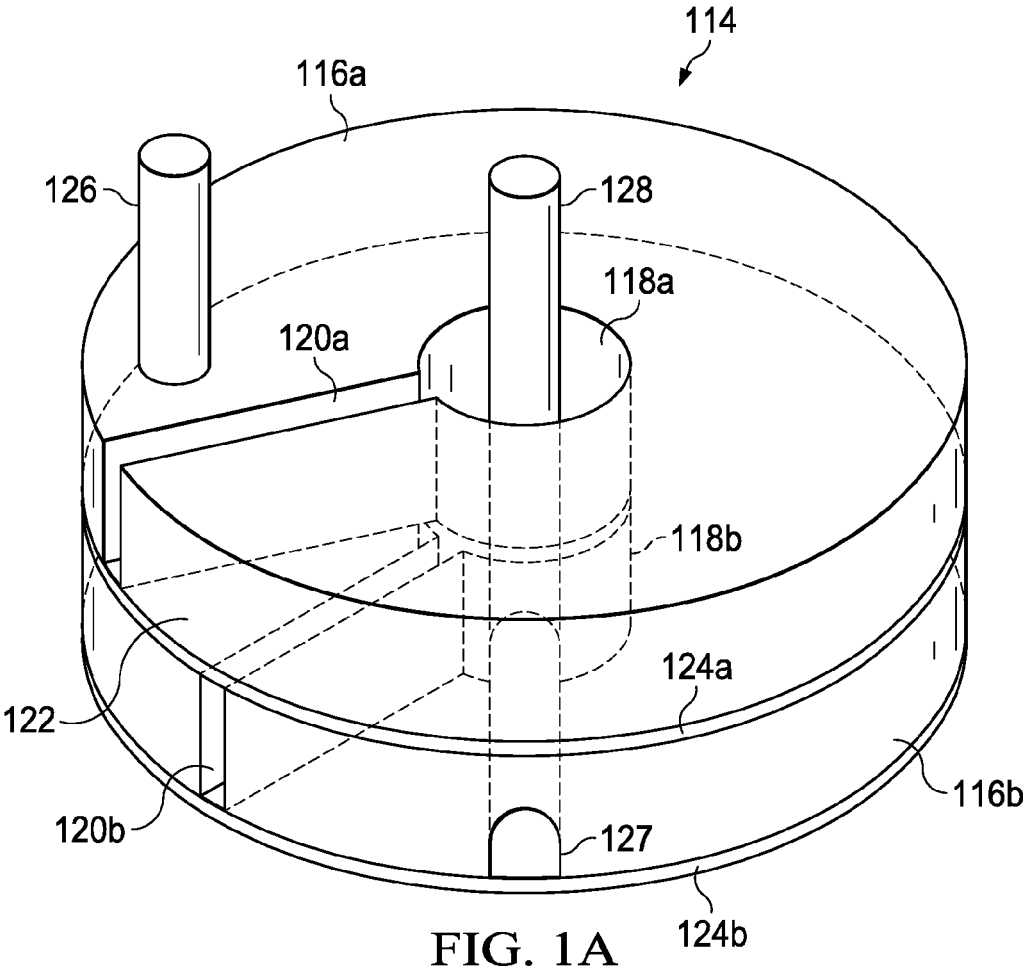
FIG. 1A (PRIOR ART)
FIGS. 1A-1B (PRIOR ART) illustrate a wide metal inductive coil which is positioned next to a magnetizing material such that when the wide metal inductive coil produces a magnetic field it is provided perpendicular to the magnetizable material being magnetized such that a North up or South up polarity magnetic source is printed in the the magnetizing material.
Figure 1B:
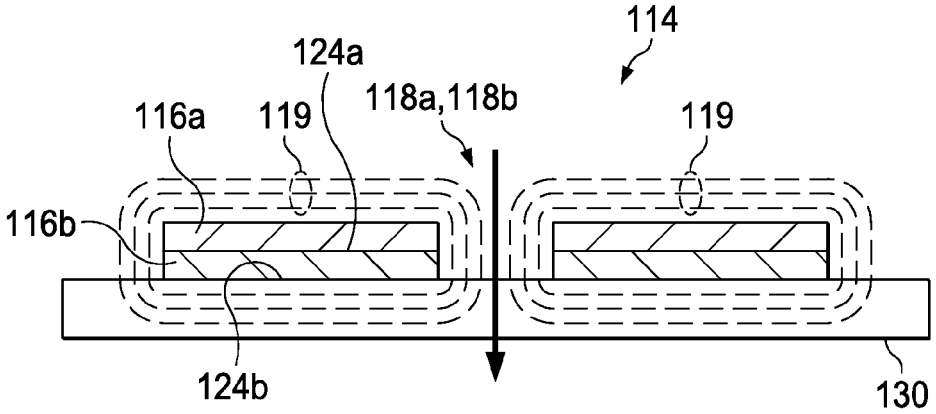
FIG. 1B (PRIOR ART)
Figure 2A:
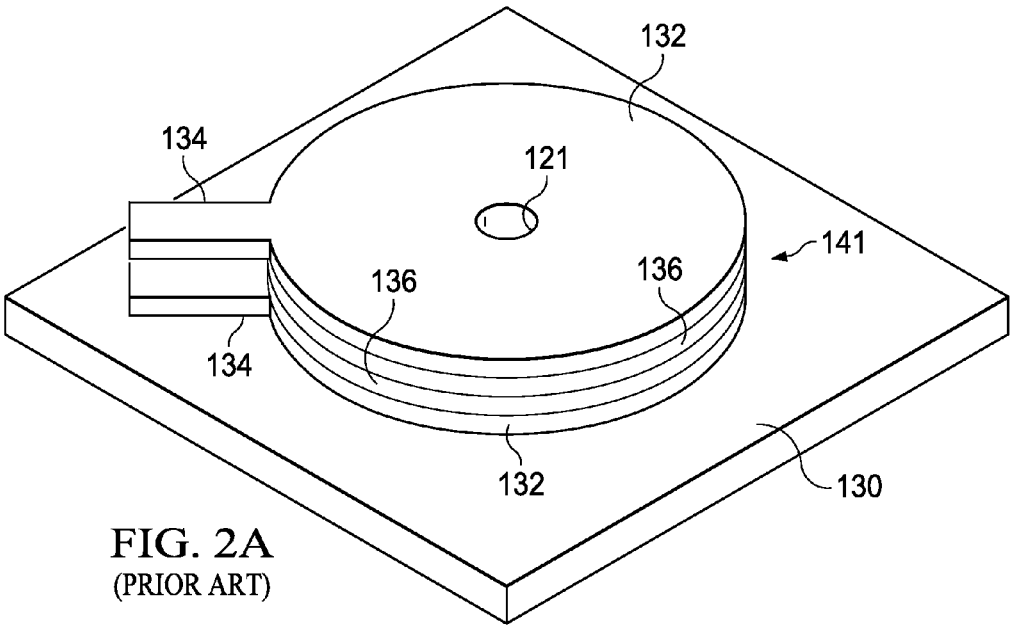
FIG. 2A (PRIOR ART)
FIGS. 2A-2E (PRIOR ART) illustrate different aspects of an exemplary magnetic print head (similar to the wide metal inductive coil of FIGS. 1A-1B) for a maxel-printing magnetic printer.
Figure 2B:
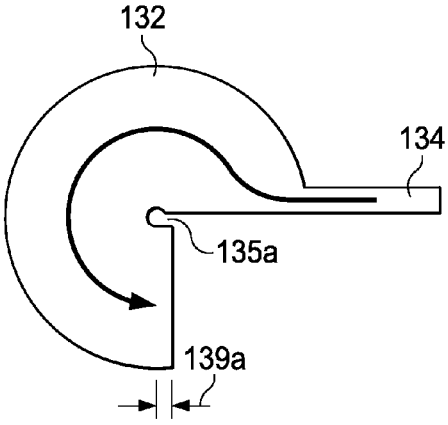
FIG. 2B (PRIOR ART)
Figure 2C:
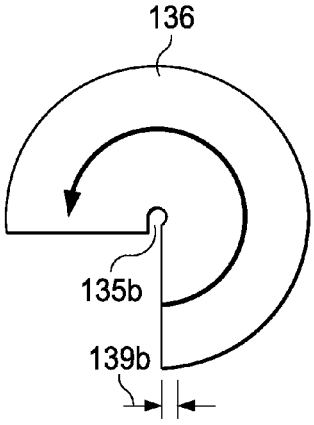
FIG. 2C (PRIOR ART)
Figure 2D:
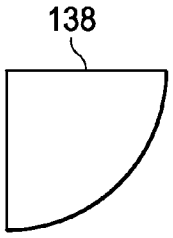
FIG. 2D (PRIOR ART)
Figure 2E:
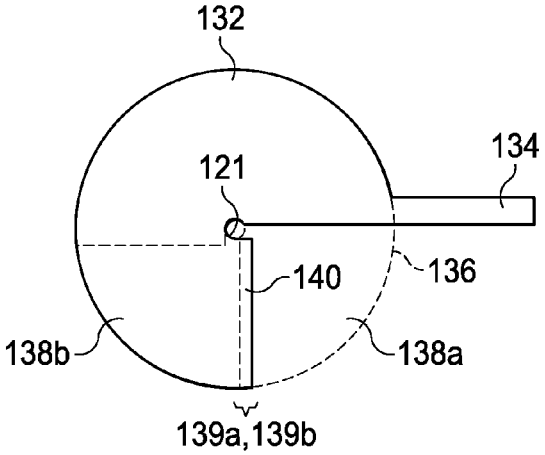
FIG. 2E (PRIOR ART)
Figure 3A:
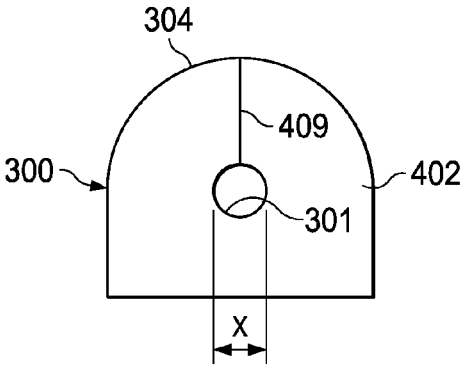
FIGS. 3A-3D are several drawings of a wide metal inductor coil that is positioned relative to a magnetizable material so as to produce a magnetic field that magnetizes the magnetizable material in a direction parallel to the magnetizable material rather than perpendicular to the magnetizable material in accordance with an embodiment of the present invention.
Figure 3B:
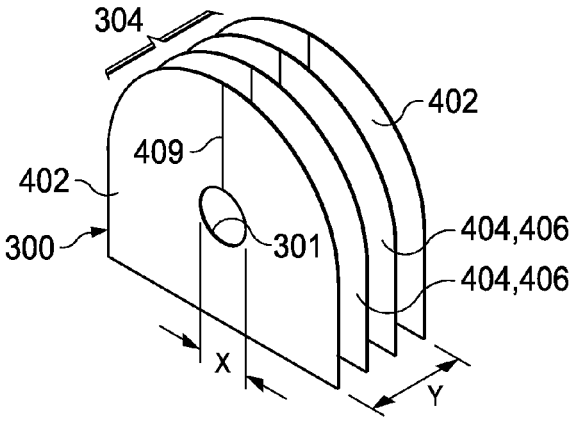
Figure 3C:
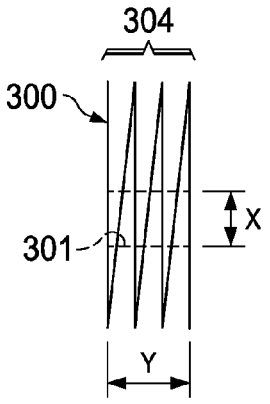
Figure 3D:
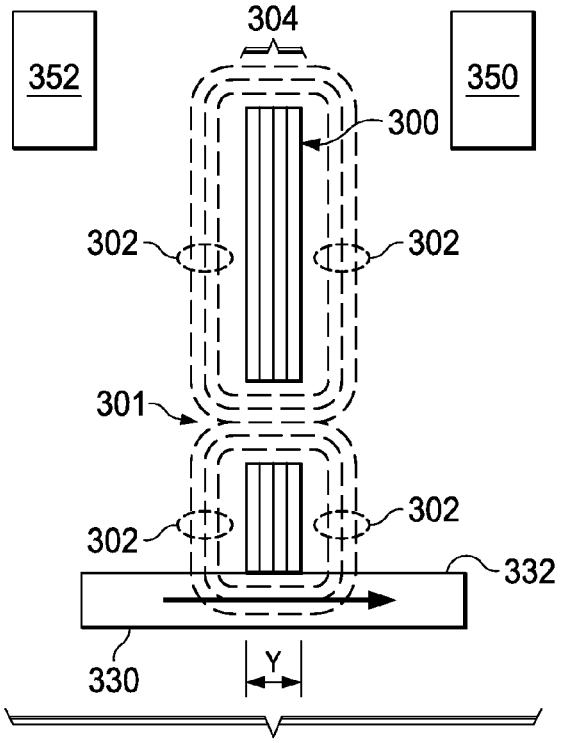

Referring to FIGS. 3A-3D, there are several drawings of a wide metal inductor coil 300 that is positioned relative to a magnetizable material 330 so as to produce a magnetic field 302 (dashed lines) that magnetizes in a direction parallel (dashed arrow) to the magnetizable material 330 rather than perpendicular to the magnetizable material 330. As discussed above, the wide metal inductor coil 114 and 141 shown in FIGS. 1-2 (PRIOR ART) are positioned so as to use the magnetic field near their hole 118 and 121 to magnetize the magnetizable material 130 in a direction that is perpendicular to the magnetizable material 130 which means there is a north up or south up polarity magnetic source printed into the surface of the magnetizing material 130. In contrast, the wide metal inductor coil 300 is positioned relative to the magnetizable material 330 such that the magnetic field 302 produced at the outer perimeter 304 rather than the magnetic field 302 produced at the hole 301 of the wide metal inductor coil 300 is used magnetize the magnetizable material 330. In the illustrated example, the wide metal inductor coil 300 is positioned such that the direction of magnetization (dashed arrow) is parallel to a surface 332 of the magnetizable material 330 which means there is a north polarity and a south polarity formed on the surface 332 of the magnetizable material 330 (see FIG. 3D's side view). The wide metal inductor coil 300 has a configuration such that the width X of the hole 301 and the height Y of the wide metal inductor coil 300, which is a function of thickness of each layer and the number of turns, determine the area on the surface 332 of a magnetizable material 330 that is subjected to the magnetic field 302 (see FIG. 3A's side view and FIG. 3C's top view). One skilled in the art with the teachings herein will readily appreciate that there is a wide variety of metal inductor coils 114, 141, 300 etc. . . . that can be positioned relative to the magnetizable material 330 (or vice versa) so as to form (print) a north polarity and a south polarity on the surface 332 of the magnetizable material 330 in accordance with the present invention. Some exemplary wide metal inductor coils 300, 500*a*, 500*b* . . . 500*n* in accordance with different embodiments of the present invention are described in detail next with respect to FIGS. 4A-4C and 5A-5I.

Figure 4A:
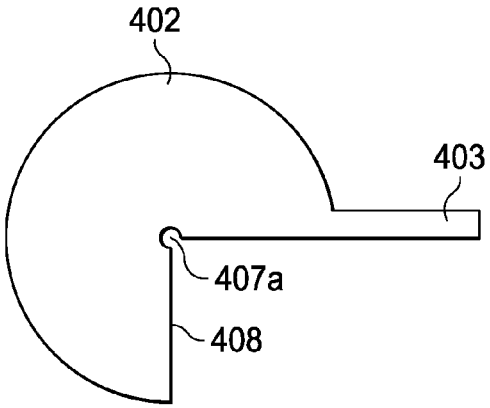
FIGS. 4A-4C show different layers which are attached via butt welds to form the wide metal inductor coil shown in FIGS. 3A-3D in accordance with an embodiment of the present invention.
Figure 4B:
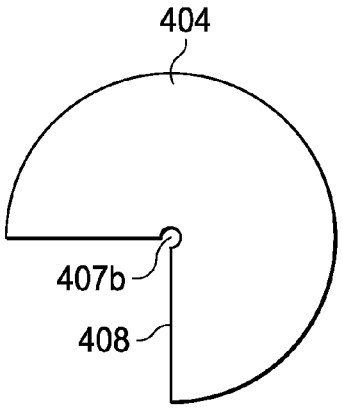
Figure 4C:
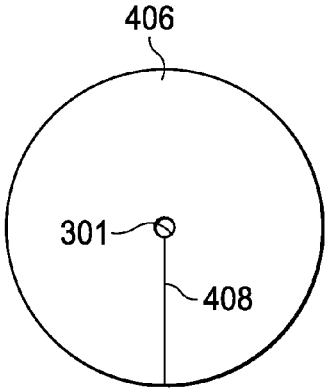
Figure 5A:
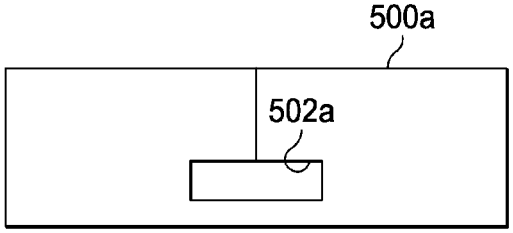
FIGS. 5A-5I are several drawings of exemplary wide metal inductor coils which have all sorts of shapes and sizes themselves and holes with all sorts of shapes and sizes in accordance with different embodiments of the present invention.
Figure 5B:
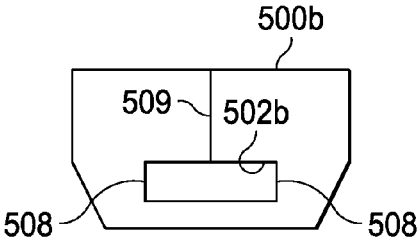
Figure 5C:
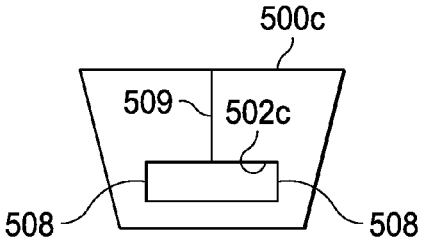
Figure 5D:
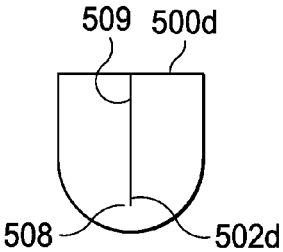
Figure 5E:
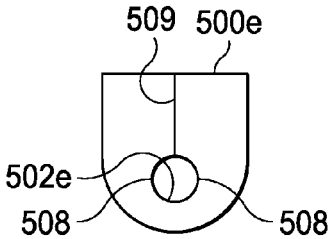
Figure 5F:
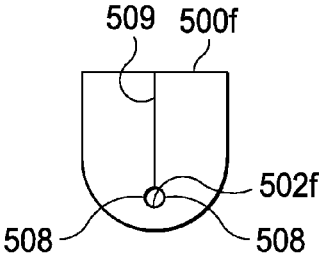
Figure 5G:
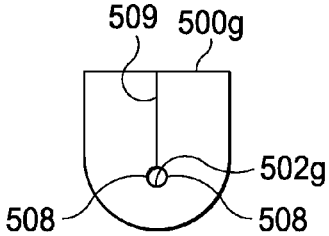
Figure 5H:
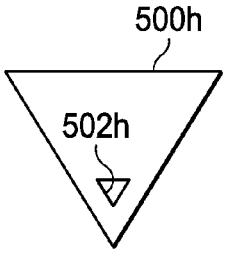
Figure 5I:
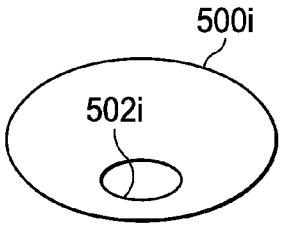

Referring to FIGS. 4A-4C, there are shown different layers 402, 404, and 406 which are attached via butt welds (where the different layers are butt-up against each other and welded together, using a laser welder) to form the aforementioned wide metal inductor coil 300. FIGS. 4A-4B respectively depict an outer layer 402 having a tab 403 and an inner layer 404. Each of the two layers 402 and 404 have an edge 408 that can be butted against another and welded to form a butt weld edge 409. Further, each of the two layers 402 and 404 define or include at least part of a hole portion 407*a* and 407*b* such that their being combined results in the formation of the hole 301 (e.g., with a 1 mm diameter) in an approximate center of the wide metal inductor coil 300 (magnetic print head 300) (see FIGS. 3A-3D). Further, the two layers 402 and 404 are similar to layers 132 and 136 in the magnetic print head 141 of FIGS. 2A-2E (PRIOR ART) except the two layers 402 and 404 do not include the overlap portions 139*a* and 139*b* in layers 132 and 136 which are used to provide the weld joint 140. FIG. 4C depicts the middle layer 406 which is a full circle with a slit that provides two edges 408, where a left edge of one layer can butt against the right edge of a layer above or beneath the layer (or vice versa). Plus, the middle layer 406 has a hole 301 formed therein.

Referring to FIGS. 5A-5I, there are shown side-views of exemplary wide metal inductor coils 500*a*, 500*b*, 500*c*, 500*d*, 500*e*, 500*f*, 500*g*, 500*h*, and 500*i* which have all sorts of sizes and shapes in accordance with different embodiments of the present invention. Further, the wide metal inductor coils 500*a*, 500*b*, 500*c*, 500*d*, 500*e*, 500*f*, 500*g*, 500*h*, and 500*i* have different shapes and sizes of holes 502*a*, 502*b*, 502*c*, 502*d*, 502*e*, 502*f*, 502*g*, 502*h*, and 502*i*. These holes 502*a*, 502*b*, 502*c*, 502*d*, 502*e*, 502*f*, 502*g*, 502*h*, and 502*i* may be just non-welded portions of abutted edges 508 which when welded to one another form weld 509. For instance, the size of the resulting hole 502*d* can be as small as the cut in the metal layer that produces the two butt edges 508 (see FIG. 5D). One skilled in the art with these teachings will recognize that all sorts of print head designs based on wide metal inductor coils 500*a*, 500*b*, 500*c*, 500*d*, 500*e*, 500*f*, 500*g*, 500*h*, and 500*i* are possible which can be used/positioned to produce a magnetic field that magnetizes the surface 332 of the magnetizable material 330 in a direction that is parallel rather than perpendicular with respect to the magnetizable material 330 which means there is a north polarity and a south polarity formed on the surface 332 of the magnetizable material 330.

Figure 6A:
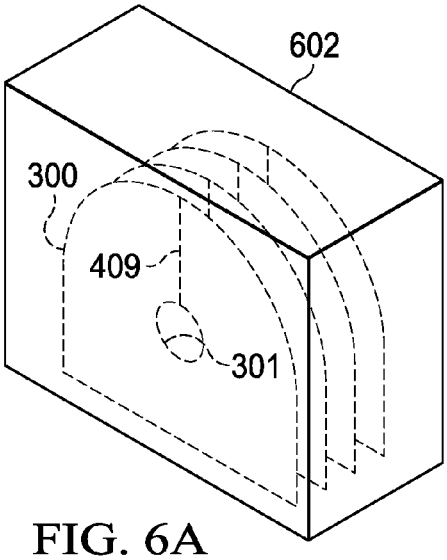
FIGS. 6A-6G are various diagrams illustrating how the wide metal inductor coils shown in FIGS. 2-5 or any wide metal inductor coil for that matter can be protected by placing it in a casting compound in accordance with an embodiment of the present invention.
Figure 6B:
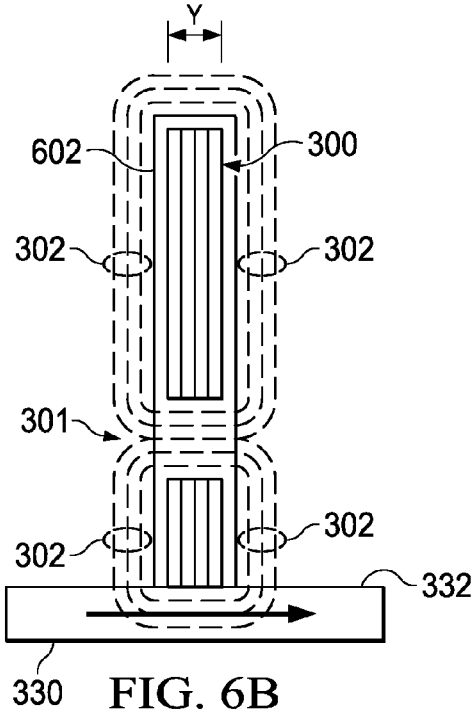
Figure 6C:
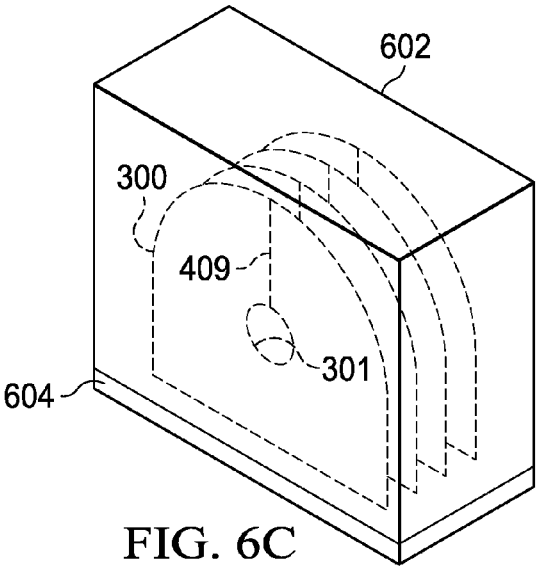
Figure 6D:
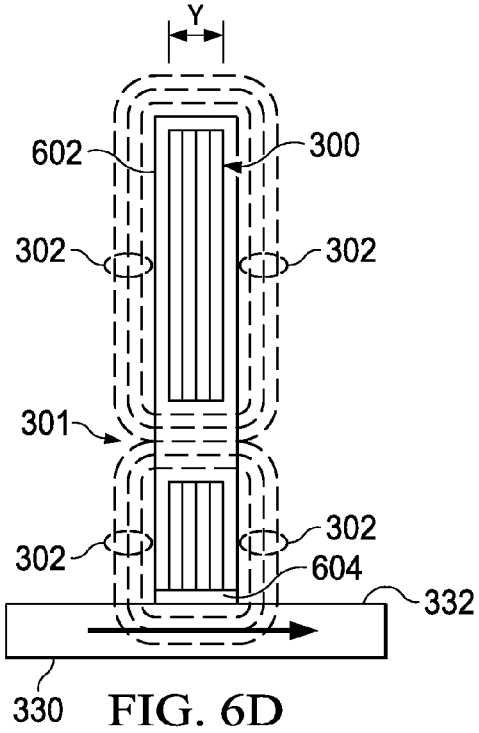
Figure 6E:
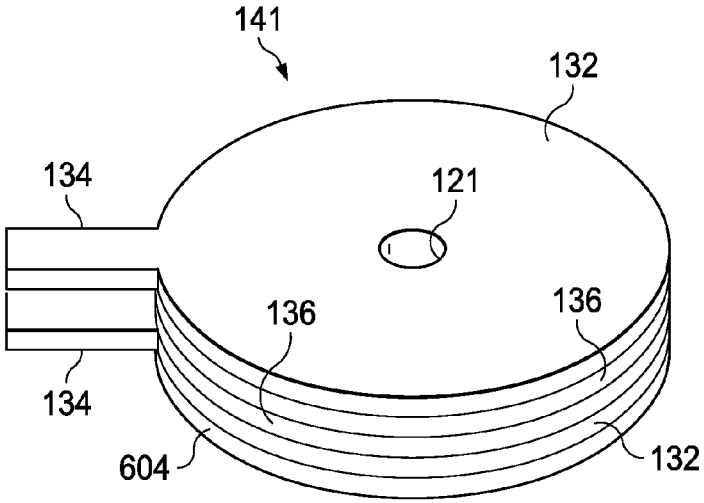
Figure 6F:
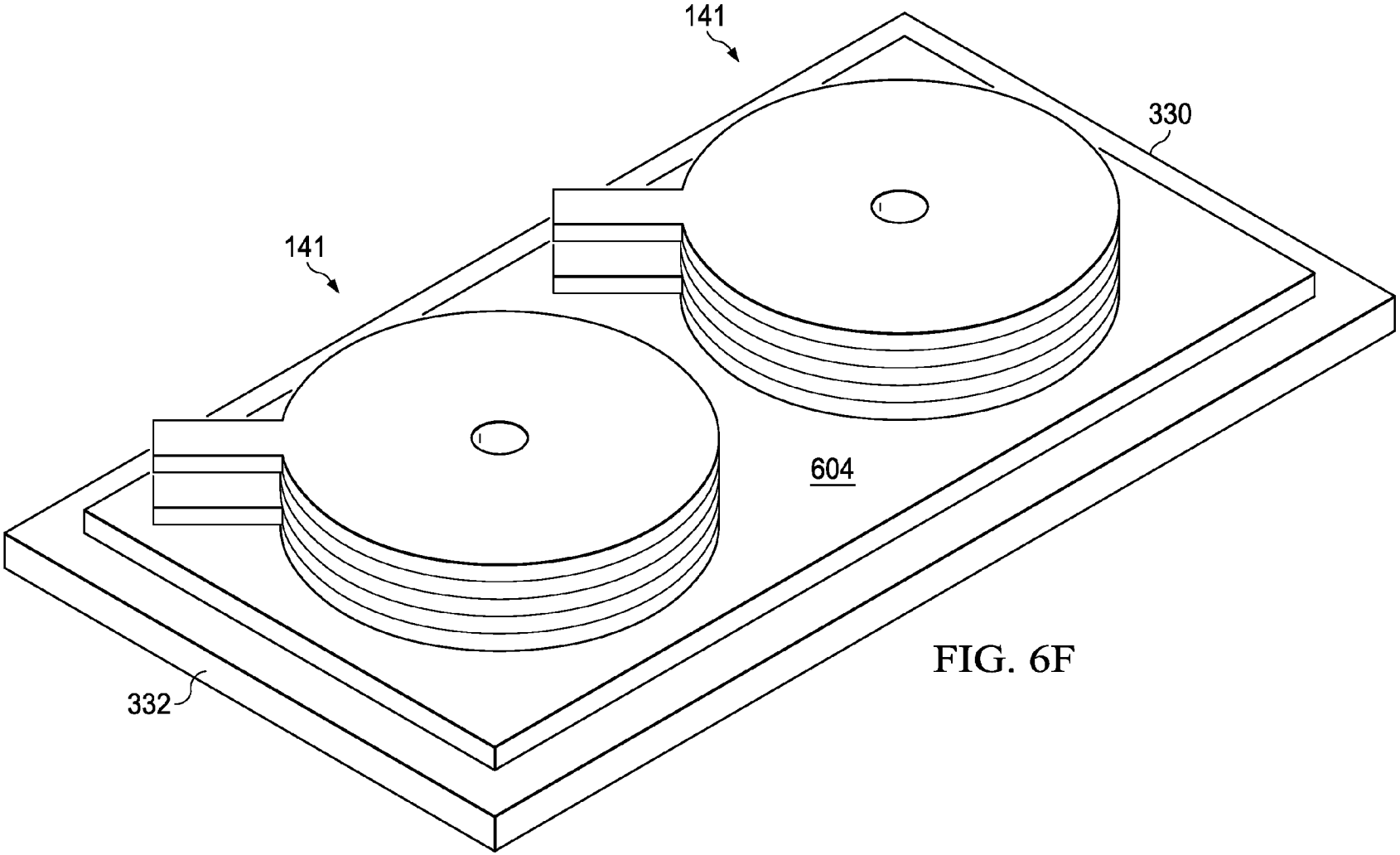
Figure 6G:
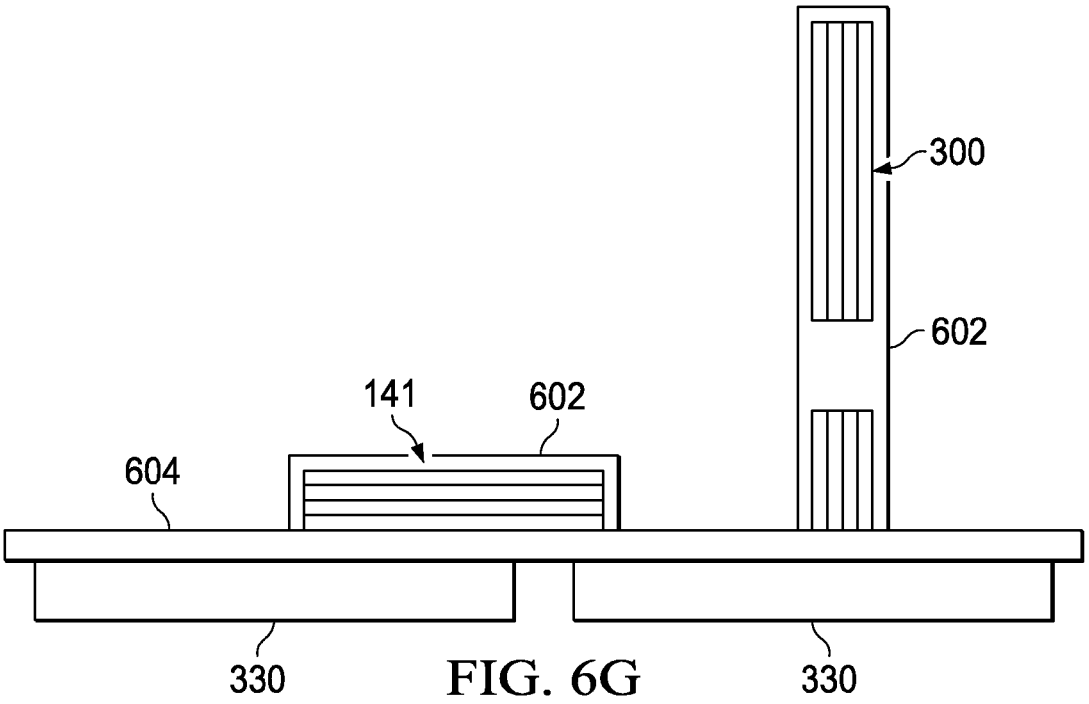

Referring to FIGS. 6A-6G, there are shown various diagrams illustrating how the aforementioned wide metal inductor coils 114, 141, 300 (shown), 500*a*, 500*b*, 500*c*, 500*d*, 500*e*, 500*f*, 500*g*, 500*h*, and 500*i* or any wide metal inductor coil for that matter can be protected by placing it in a casting compound 602 (e.g., acrylic casting compound 602) in accordance with an embodiment of the present invention. The casting compound 602 will harden and prevent damage to wide metal inductor coil 300, which is typically made up of thin relatively soft metal layers of copper. FIG. 6B shows a side-view of the wide metal inductor coil 300 (for example) encapsulated with the casting compound 602 and placed next to the magnetizable material 330 so as to produce the magnetic field 302 that magnetizes the surface 332 of the magnetizable material 330 in a direction that is parallel (see dashed arrow) rather than perpendicular which means there is a north polarity and a south polarity formed on the surface 332 of the magnetizable material 330. In FIGS. 6C-6D, the wide metal inductor coil 300 (for example) is shown which is not only encapsulated with the casting compound 602 but also has a protective layer 604 attached thereto. The protective layer 604 could be a thin metal layer such as a 0.003" thick layer of titanium or chrome. The protective layer 604 can be used in addition to the casting compound 602 (as shown) or as an alternative to the casting compound 602 depending on the application. For example, the protective layer 604 can be placed at the bottom of an individual inductor coil such as the wide metal inductor coil 141 without using the casting compound 602 (see FIG. 6E). Alternatively, the protective layer 604 can be between multiple inductor coils 141 and the magnetizable material 330 (see FIG. 6F). Or, the protective layer 604 can be between inductor coils 141 and 300 and the magnetizable material 330 (see FIG. 6G) where in this example the two inductor coils 141 and 300 are also protected by the casting compound 602. If desired, an insulating layer (e.g., insulating layer 124*b*) can be placed between an inductor coil, such as inductor coil 300, and the protective layer 604 as necessary to prevent current from conducting between the inductor coil 300 (for example) and the protective layer 604. Generally, one skilled in the art will recognize with the teachings herein that casting compounds 602 and/or protective layers 604 can be used to enable the print head (e.g., wide metal inductor coil 114, 141, 300 (shown), 500*a*, 500*b*, 500*c*, 500*d*, 500*e*, 500*f*, 500*g*, 500*h*, and 500*i*) to be moved across the magnetizable material 330 from one maxel location to another without lifting the print head or magnetizable material 330 (or vice versa) so as to avoid damage to the print head during such movement.

Figure 7A:
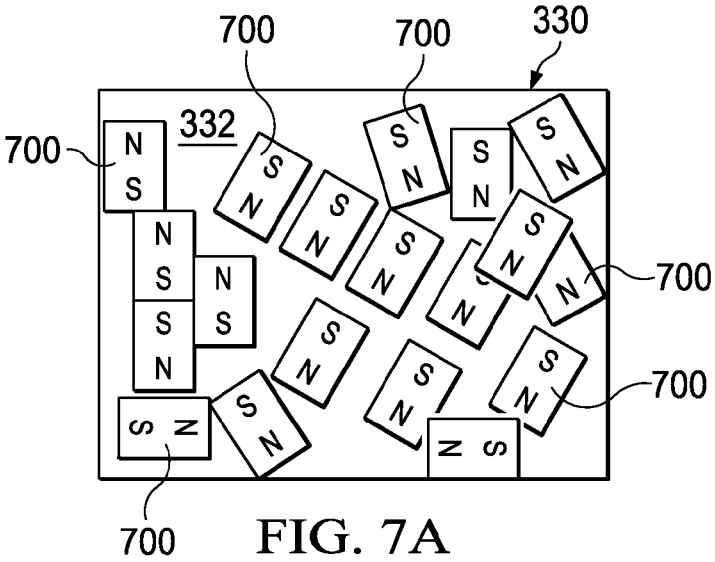
FIGS. 7A-7D are several drawings of exemplary magnetic structures (maxels) that can be formed on the magnetizable material in accordance with different embodiments of the the present invention.
Figure 7B:
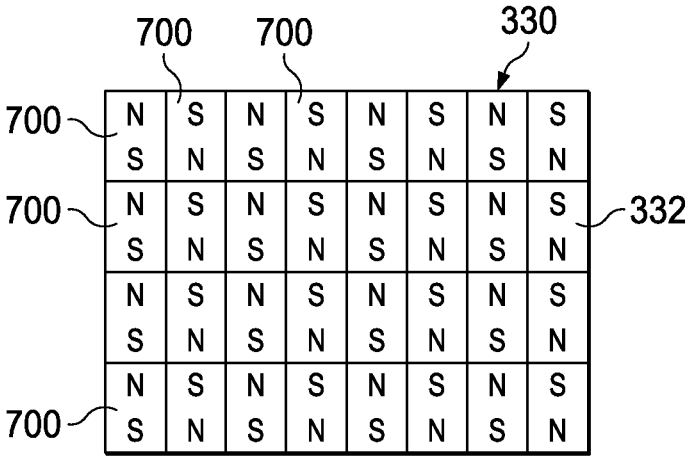
Figure 7C:
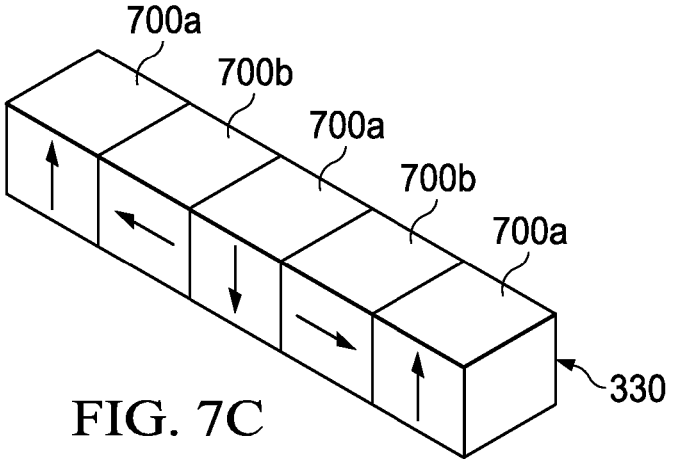
Figure 7D:
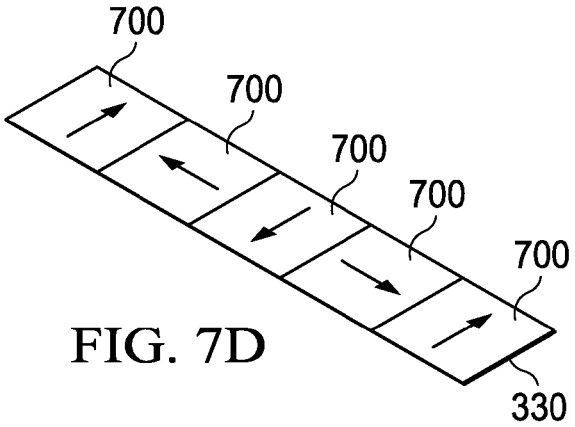
Figure 8A:
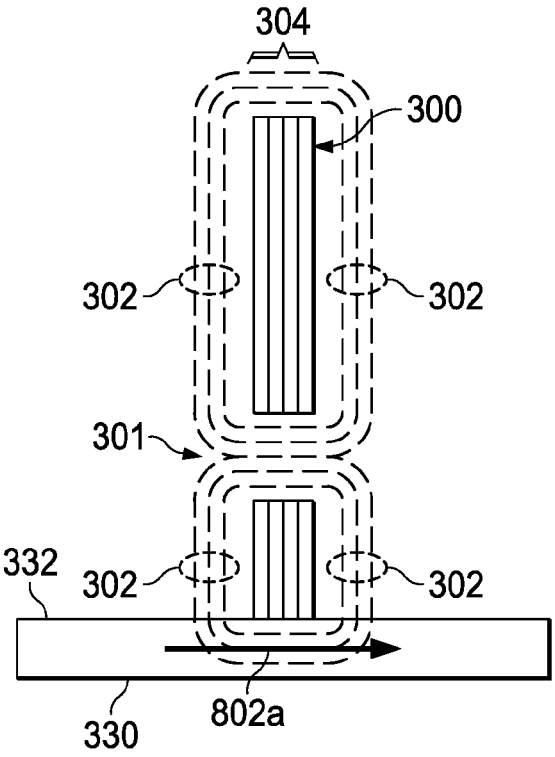
FIGS. 8A-8L are various side-view diagrams which illustrate how a print head (wide metal inductor coil) can be tilted relative to the surface of the magnetizable material such that the magnetic field on the print head's outer perimeter magnetizes (prints) a magnetic source (maxel) on the magnetizable material in a direction other than perpendicular and other than parallel to the magnetizable material in accordance with different embodiments of the present invention.
Figure 8B:
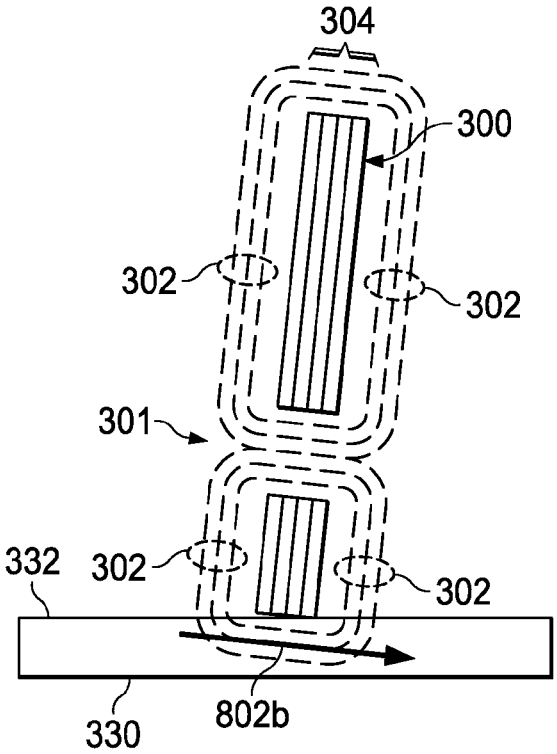
Figure 8C:
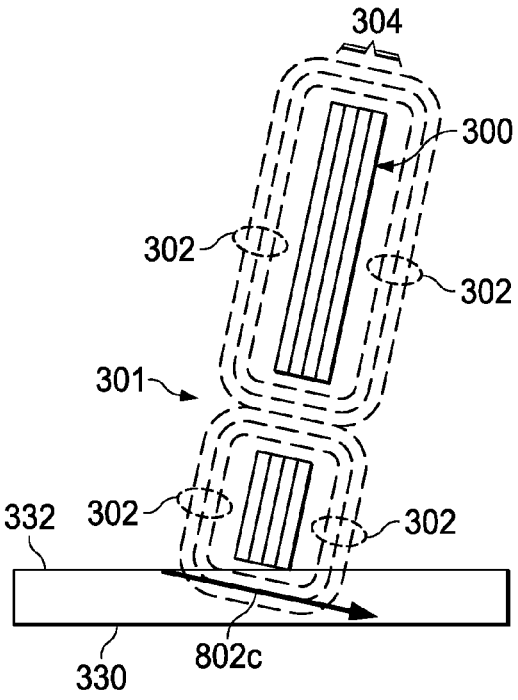
Figure 8D:
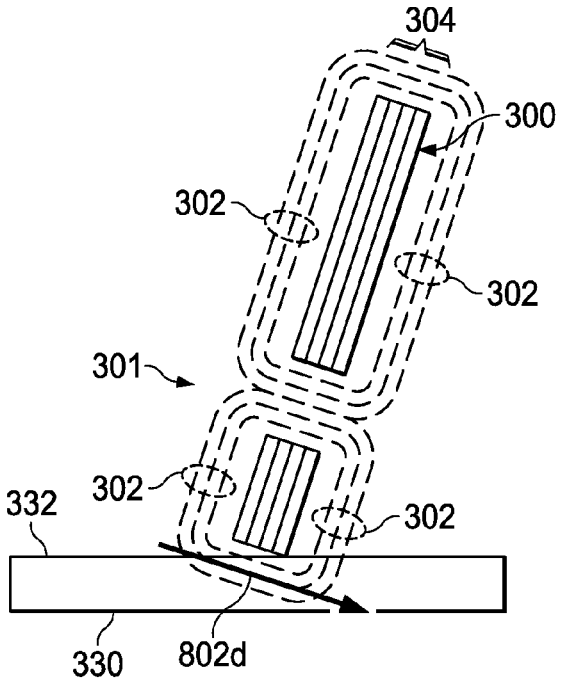
Figure 8E:
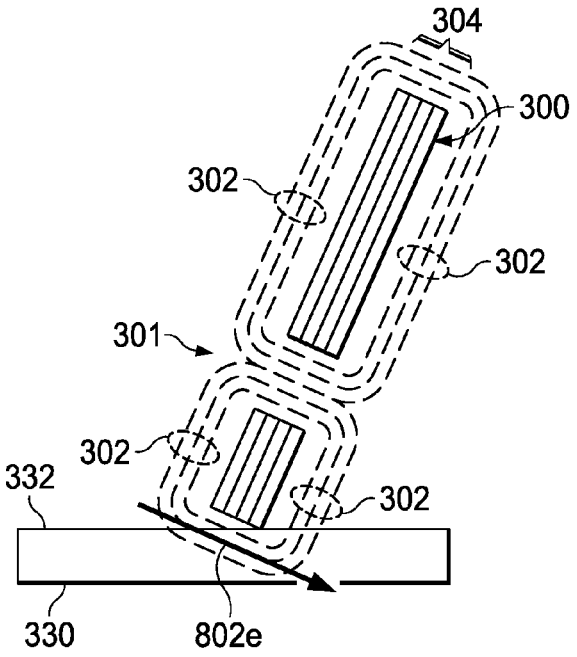
Figure 8F:
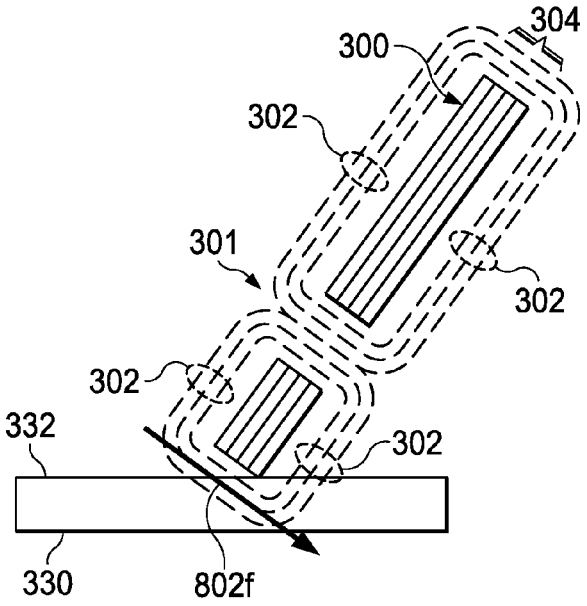
Figure 8G:
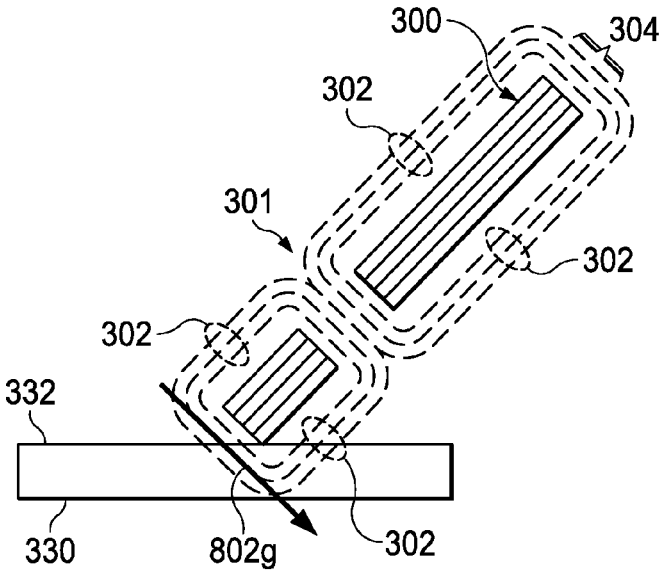
Figure 8H:
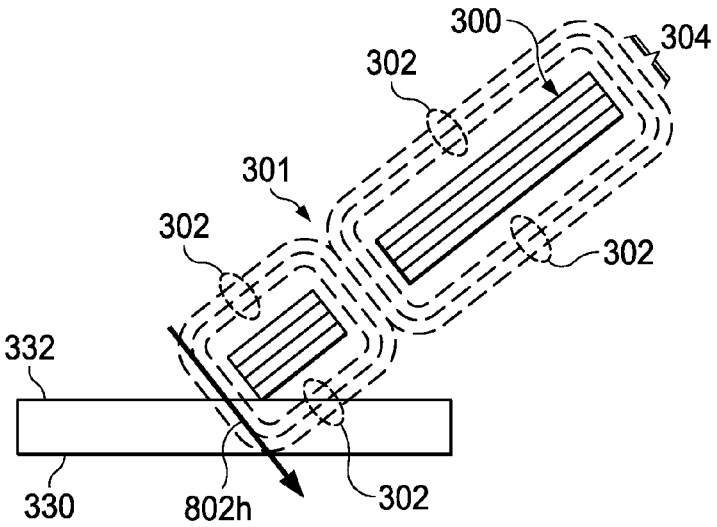
Figure 8I:
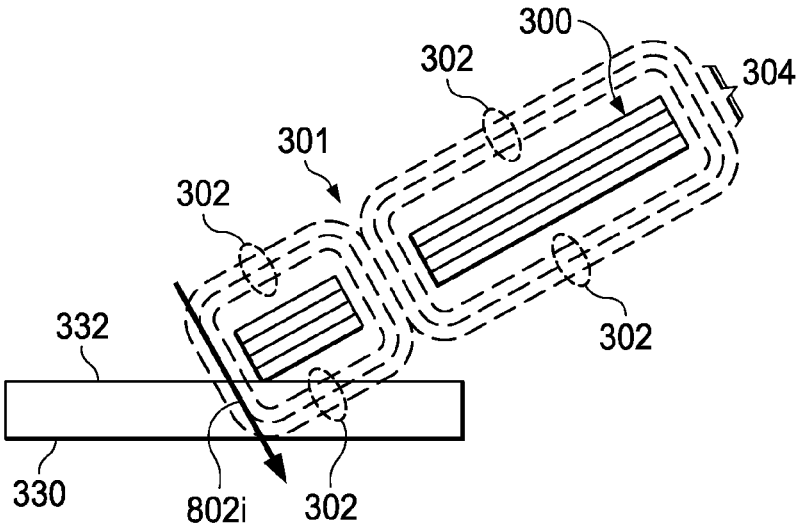
Figure 8J:
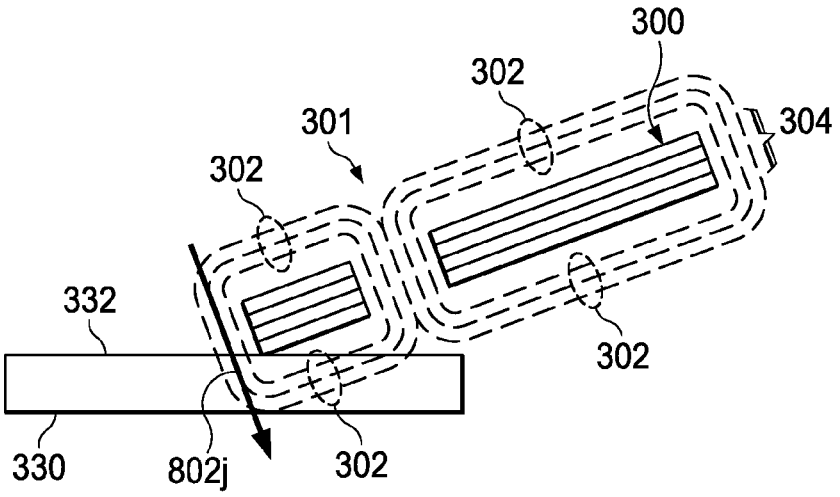
Figure 8K:
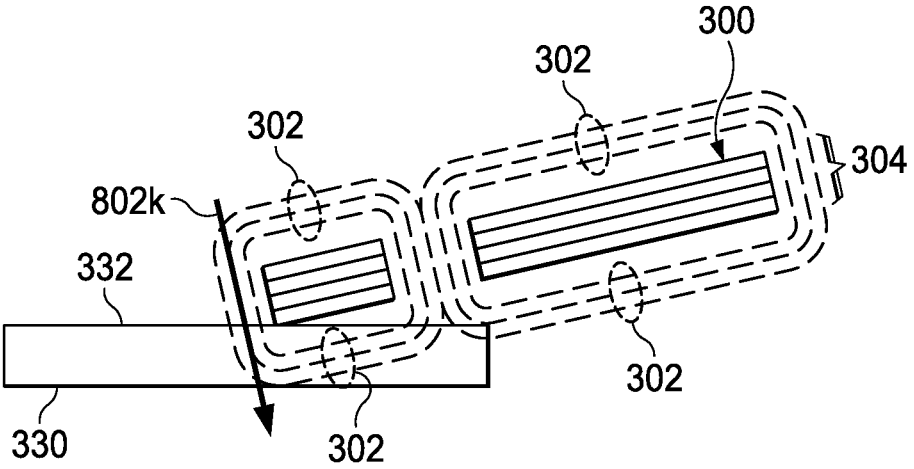
Figure 8L:
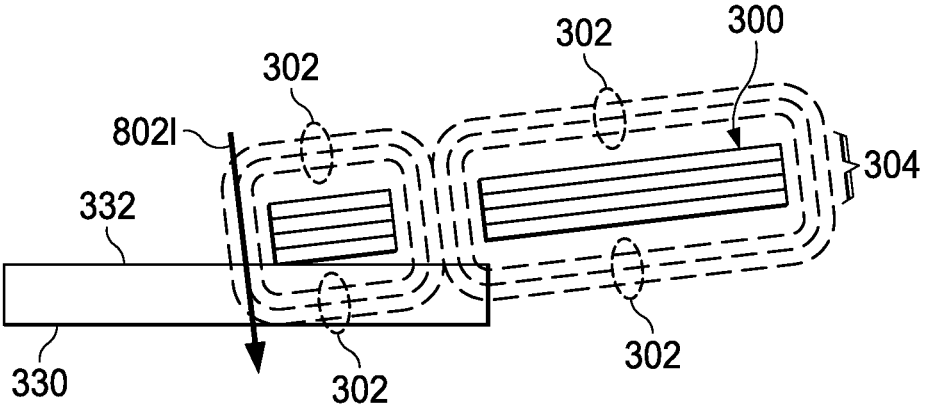

Referring to FIGS. 7A-7D, there are illustrated several drawings of exemplary magnetic structures 700 (maxels 700) that can be formed on the magnetizable material 330 in accordance with the present invention. FIG. 7A depicts multiple magnetic sources 700 (19 shown) printed parallel to the surface 332 of the magnetizable material 330 in somewhat of a random pattern, where each magnetic source 700 has a south polarity portion and a north polarity portion. It should be appreciated that the print head (e.g., wide metal inductor coil 300) and or the magnetizable material 330 can be rotated to establish the print direction of each magnetic source 700. FIG. 7B depicts rows and columns of printed magnetic sources 700 that resemble a checkerboard pattern on the surface 332 of the magnetizable material 330. FIG. 7C depicts magnetic sources 700*a* and 700*b* in a Halbach array pattern printed into an axially sintered magnetizable material 330 where a "vertical" print head 141 (for example) can be used to produce the South Up or North up polarity magnetic sources 700*a* and a "horizontal" print head 300 (for example) can be used to produce the South-North and North South magnetic sources 700*b*. FIG. 7D depicts a Halbach array pattern of magnetic sources 700 printed into a diametrically sintered magnetizable material 330 using a "horizontal" print head 300 (for example) where the direction of printing is a function of rotating the magnetizable material 330 or the "horizontal" print head 300. It should be noted that due to the magnetization direction on the magnetizable material 330, the field strength used to print magnetic sources 700 which are printed "with the grain" can be less than the field strength used to print magnetic sources 700 "against the grain" so as to compensate for magnetization limitations.

Referring to FIGS. 8A-8J, there are various side-view diagrams which illustrate how a print head 300 (for example) can be tilted relative to the surface 332 of the magnetizable material 330 such that the magnetic field 302 on the print head's outer perimeter 304 magnetizes (prints) a magnetic source (maxel) on the magnetizable material 330 in a direction (see arrows) other than perpendicular and other than parallel to the magnetizable material 330. In this example, FIGS. 8A-8L show several exemplary tilted print head 300 (tilted wide metal inductor coil 300) configurations to illustrate how different magnetization directions 802*a*, 802*b*, 802*c*, 802*d*, 802*e*, 802*f*, 820*g*, 802*h*, 802*i*, and 802*l* (dashed arrows) can be produced in the magnetizable material 330.

Figure 9A:
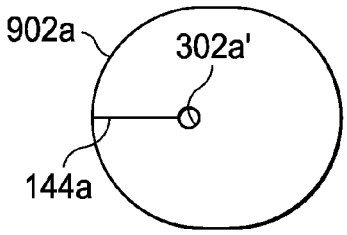
FIGS. 9A-9F are several diagrams illustrating a print head (wide metal inductor coil) which has angled hole formed therein in accordance with an embodiment of the present invention.
Figure 9B:
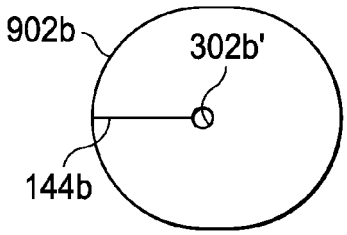
Figure 9C:
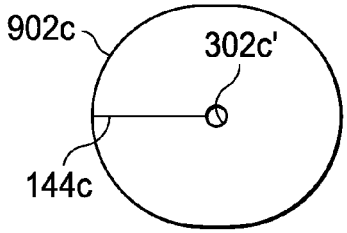
Figure 9D:
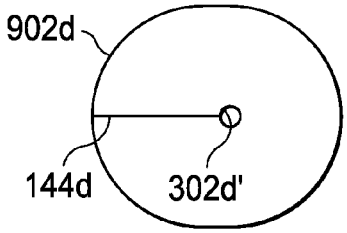
Figure 9E:
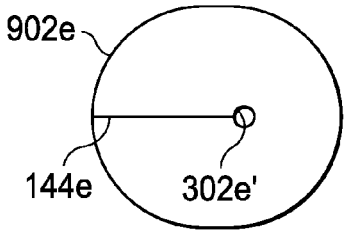
Figure 9F:
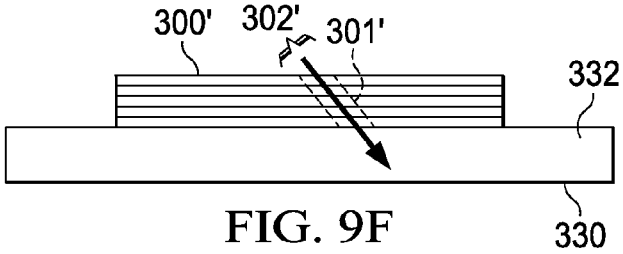

Referring to FIGS. 9A-9F, there are several diagrams illustrating a print head 300' (wide metal inductor coil 300') which has angled hole 302' formed therein in accordance with an embodiment of the present invention. In particular, the print head 300' has a hole 302' that is slanted through the coil such that it can magnetize the magnetizable material 330 in a direction other than perpendicular or parallel to the surface 332 of the material 330. In this example, the wide metal inductor coil 300' is made from multiple layers 902*a*, 902*b*, 902*c*, 902*d* and 902*e* each having holes 302*a*', 302*b*', 302*c*', 302*d*' and 302*e*' at five different positions (from left to right) such that when the layers 902*a*, 902*b*, 902*c*, 902*d* and 902*e* are assembled they collectively form the angled hole 302' in the wide metal inductor coil 300'. FIGS. 9A-9E respectively show top views of layers 902*a*, 902*b*, 902*c*, 902*d* and 902*e* with their respective holes 302*a*', 302*b*', 302*c*', 302*d*' and 302*e*' which are offset from one another such that when they are assembled they form the wide metal inductor coil 300' with the angled hole 302'. FIG. 9F is a side view of the wide metal inductor coil 300' positioned next to the magnetizing material 330 so as to magnetize the magnetizable material 330 in a direction (see arrow) other than perpendicular or parallel to the surface 332 of the material 330.

In view of the foregoing, one skilled in the art will readily appreciate that the present invention includes a system and a method for magnetizing magnetic sources into a magnetizable material. For instance, the system could include an inductor coil 300 (for example)(actually multiple inductor coils could be used), a positioning device 350, and an electrical power source 352 (see FIG. 3D). The inductor coil 300 which has multiple layers 402, 404 and 406 forming a coil and a hole 301 extending through the multiple layers 402, 404 and 406. The positioning device 350 is configured to position the inductor coil 300 next to the magnetizable material 330 (or vice-versa). The electrical power source 352 is configured to provide electricity to the inductor coil 300 such that the inductor coil 300 emits a magnetic field 302 that magnetizes an area on a surface 332 of the magnetizable material 330, wherein the area on the surface 332 of the magnetizable material 330 is magnetized in a direction other than perpendicular to the magnetizable material 330 such that a magnetic dipole with both a north polarity and a south polarity is formed on the surface 332 of the magnetizable material 330.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims. It should also be noted that the reference to the "present invention" or "invention" used herein relates to exemplary embodiments and not necessarily to every embodiment that is encompassed by the appended claims.

The invention claimed is:

1. A system for magnetizing magnetic sources into a magnetizable material, the system comprising:

an inductor coil having multiple layers forming a coil and a hole extending through the multiple layers;

a positioning device configured to position an outer perimeter of the inductor coil next to a surface of the magnetizable material; and an electrical power source configured to provide electricity to the inductor coil such that the inductor coil produces a magnetic field at the outer perimeter of the inductor coil that magnetizes an area on the surface of the magnetizable material, wherein the area on the surface of the magnetizable material is magnetized in a direction other than perpendicular to the surface of the magnetizable material such that there is a magnetic dipole with both a north polarity and a south polarity formed on the surface of the magnetizable material.

2. The system of claim 1, wherein the positioning device is further configured to tilt the inductor coil with respect to the magnetizable material such that the inductor coil emits the magnetic field to magnetize the area of the surface of the magnetizable material in a direction other than perpendicular to the magnetizable material and other than parallel to the magnetizable material.

3. The system of claim 1, further comprising a protective layer which is placed between the inductor coil and the magnetizable material.

4. The system of claim 1, wherein the multiple layers are welded to one another to form the coil with a number of turns.

5. The system of claim 4, wherein the weld is an overlap weld or a butt weld.

6. The system of claim 1, wherein a height of the coil which is a function of a thickness of each layer and the number of turns along with a width of the hole determines the area on the surface of the magnetizable material that is magnetized by the inductor coil.

7. The system of claim 1, wherein the inductor coil is placed in a casting compound.

8. The system of claim 1, wherein the hole formed in the inductor coil is a slanted hole.

9. The system of claim 1, wherein the hole formed in the inductor coil is either a rectangular-shaped hole, a circular-shaped hole, a triangular-shaped hole, or an oval-shaped hole.

10. The system of claim 1, further comprising:

another inductor coil having multiple layers forming a coil and a hole extending through the multiple layers;

the positioning device is configured to also position the another inductor coil next to the surface of the magnetizable material; and the electrical power source is also configured to provide electricity to the another inductor coil such that the another inductor coil produces a magnetic field at the outer perimeter of the coil that magnetizes another area on the surface of the magnetizable material, wherein the another area on the surface of the magnetizable material is magnetized in a perpendicular direction such that there is a magnetic dipole with either a north polarity or a south polarity formed on the surface of the magnetizable material.

11. A method for magnetizing magnetic sources into a magnetizable material, the method comprising:

providing an inductor coil having multiple layers forming a coil and a hole extending through the multiple layers;

positioning an outer perimeter of the inductor coil next to a surface of the magnetizable material; and producing a magnetic field at the outer perimeter of the inductor coil that magnetizes an area on the surface of the magnetizable material, wherein the area on the surface of the magnetizable material is magnetized in a direction other than perpendicular to the surface of the magnetizable material such that there is a magnetic dipole with both a north polarity and a south polarity formed on the surface of the magnetizable material.

12. The method of claim 11, wherein the positioning step further includes a step of tilting the inductor coil with respect to the magnetizable material such that the inductor coil emits the magnetic field to magnetize the area of the surface of the magnetizable material in a direction other than perpendicular to the magnetizable material and other than parallel to the magnetizable material.

13. The method of claim 11, further comprising a step of placing a protective layer between the inductor coil and the magnetizable material.

14. The method of claim 11, wherein the multiple layers are welded to one another to form the coil with a number of turns.

15. The method of claim 14, wherein the weld is an overlap weld or a butt weld.

16. The method of claim 11, wherein a height of the coil which is a function of a thickness of each layer and the number of turns along with a width of the hole determines the area on the surface of the magnetizable material that is magnetized by the inductor coil.

17. The method of claim 11, wherein the inductor coil is placed in a casting compound.

18. The method of claim 11, wherein the hole formed in the inductor coil is a slanted hole.

19. The method of claim 11, wherein the hole formed in the inductor coil is either a rectangular-shaped hole, a circular-shaped hole, a triangular-shaped hole, or an oval-shaped hole.

20. The method of claim 11, further comprising steps of:

providing another inductor coil having multiple layers forming a coil and a hole extending through the multiple layers;

positioning the another inductor coil next to the magnetizable material; and producing a magnetic field at the outer perimeter of the another inductor coil that magnetizes another area on the surface of the magnetizable material, wherein the another area on the surface of the magnetizable material is magnetized in a perpendicular direction such that there is a magnetic dipole with either a north polarity or a south polarity formed on the surface of the magnetizable material.

* * * * *